US008188835B2

(12) United States Patent
Inschlag et al.

(10) Patent No.: US 8,188,835 B2
(45) Date of Patent: May 29, 2012

(54) POTENTIOMETER

(75) Inventors: Josef Inschlag, Bruck an der Lafnitz (AT); Marcus Eder, Vienna (AT)

(73) Assignee: Otto Bock HealthCare Products GmbH, Vienna (AT)

( * ) Notice: Subject to any disclaimer, the term of this patent is extended or adjusted under 35 U.S.C. 154(b) by 432 days.

(21) Appl. No.: 12/524,202

(22) PCT Filed: Jan. 21, 2008

(86) PCT No.: PCT/IB2008/001100

§ 371 (c)(1),
(2), (4) Date: Jul. 23, 2009

(87) PCT Pub. No.: WO2008/090478

PCT Pub. Date: Jul. 31, 2008

(65) Prior Publication Data

US 2009/0322465 A1 Dec. 31, 2009

(30) Foreign Application Priority Data

Jan. 24, 2007 (DE) ..... 10 2007 004 536
Mar. 28, 2007 (DE) ..... 10 2007 014 751

(51) Int. Cl.
*H01C 10/48* (2006.01)

(52) U.S. Cl. ..... 338/190; 338/160; 338/162

(58) Field of Classification Search ..... 338/190, 338/192, 160–162
See application file for complete search history.

(56) References Cited

U.S. PATENT DOCUMENTS 4,682,364 A * 7/1987 Dunnebacke ..... 381/109
2006/0176143 A1* 8/2006 Ebnet ..... 338/68

FOREIGN PATENT DOCUMENTS

| | | |
|---|---|---|
| DE | 3427000 | 1/1986 |
| DE | 298 12 976 | 11/1998 |
| DE | 603 00 688 | 11/2005 |
| EP | 1 228 500 | 5/2005 |
| EP | 1688970 | 8/2006 |

* cited by examiner

*Primary Examiner* — Kyung Lee
(74) *Attorney, Agent, or Firm* — Whitham Curtis Christofferson & Cook, PC

(57) ABSTRACT

The invention relates to a potentiometer comprising (a) at least two electrically conducting segments (12), each of which has a contact end (14) that is bordered by a circumferential edge (16) and which adjoin each other in a flush manner by means of one respective section (18, 20) of the edges (16) thereof, and (b) a connecting device (38) for electrically connecting a first contact point ($P_1$) in a first segment to at least one second contact point ($P_2$, $P_3$) in a second segment that is different from the first segment.

21 Claims, 17 Drawing Sheets

POTENTIOMETER

Figure 1B:
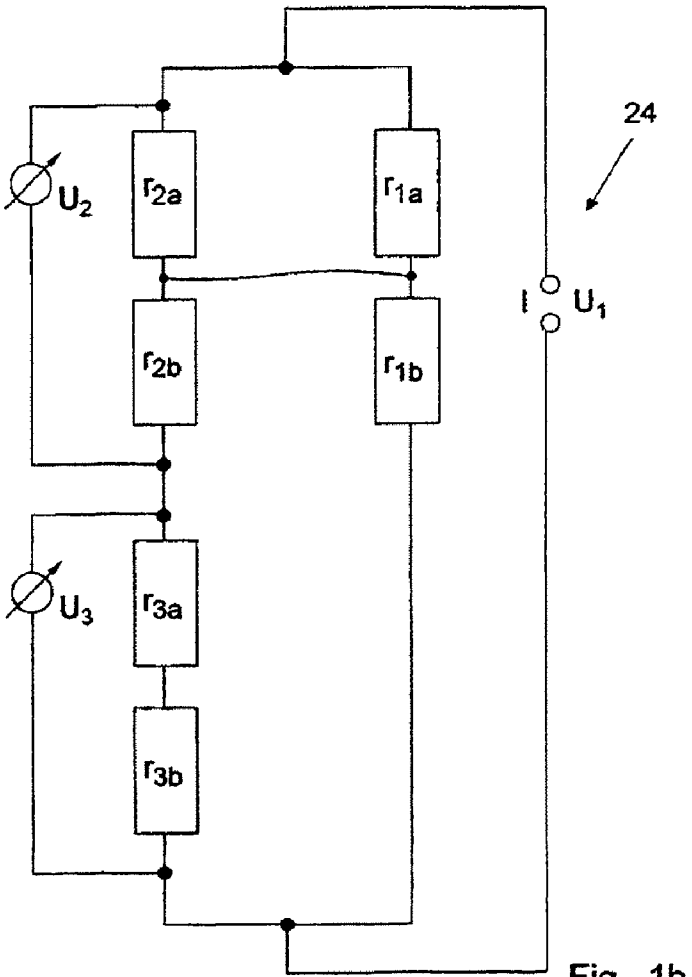

The invention relates to a potentiometer, having (a) at least two electrically conductive segments, which respectively have a contact side which is delimited by a circumferential edge, which respectively adjoin one another such that a section of their edges is flush, and (b) a connecting apparatus for electrically connecting a first contact point in a first segment to at least one second contact point in a second segment, which is different than the first segment, and to a method for ascertaining an angular position for a component using a potentiometer according to the invention.

Potentiometers are frequently used to measure angular positions, that is to say to ascertain twisting of one body relative to another. So that all angular positions can be measured, that is to say that no dead angle arises, it is necessary to make modifications with respect to conventional potentiometers. A potentiometer without a dead angle is disclosed in Korean Laid-Open Specification KR 10 2001 099 256 A, for example. A drawback of the potentiometer disclosed therein is that it is difficult to encapsulate. It is therefore susceptible to soiling. A further drawback is that both parts of the potentiometer carry current, and the potentiometer is therefore susceptible to error.

DE 34 27 000 C2 discloses a potentiometer of the type in question in which two wipers are connected to one another and to an output amplifier. An electric current impressed into the segments by means of the two wipers is routed to a further segment from the segments with which contact is made by the wiper and is supplied to loudspeakers from said further segment. A drawback of the potentiometer described therein is that the wiper contacts need to be connected to the current source at a center of rotation. An electrical resistance which changes at this point results in a systematic measurement error. Another drawback is that the potentiometer can be operated only in an angle range of 0 to 180°. It therefore cannot be used for applications in which arbitrary angles need to be able to be set.

DE 10 2005 021 890 A1 discloses a potentiometer which has three concentric conductors. Two rotatably mounted arms can be used to connect two respective conductors to one another. The central one of the three conductors has an increased electrical resistance, which means that it is possible to use the electrical resistance between the outer and the inner electrical conductor to infer a rotary position for the arms. A drawback of the potentiometer is its complex design.

DE 43 39 931 C1 discloses a position sensor for the gear selector lever in a motor vehicle transmission. The drawback of the position sensor is that it is not suitable for sensing a rotary movement.

The invention is based on the object of proposing a robust potentiometer which can be used to sense the angular position of a component at all angles.

The invention solves the problem by means of a potentiometer of the type in question in which an electrical contact is constantly arranged between two respective segments.

In line with a second aspect, the invention solves the problem by means of a method for ascertaining an angular position for a component, having the following steps: (a) the component is mechanically connected to a connecting apparatus or the segments of a potentiometer as claimed in one of the preceding claims, (b) a current source or a voltage source is connected to the potentiometer, so that an electric current flows through at least one segment, (c) at least one first voltage which drops across a portion of the potentiometer on the basis of the current is ascertained, (d) the at least one voltage is used to ascertain a rotary position for the connecting apparatus, and (e) the rotary position of the connecting apparatus is used to ascertain the angular position of the component.

An advantage of the potentiometer according to the invention is that it is not necessary for a current or a voltage to be tapped off from a rotatably mounted component. It is possible to make electrical contact with either only the segments or only the connecting apparatus. This means that the potentiometer becomes particularly robust. A further advantage is that it is simple to manufacture and hence inexpensive to produce. It is also possible for the potentiometer to be of open design.

Another advantage is that it can be produced in a flat design. A further advantage is that the potentiometer can be encapsulated such that no rotatably mounted components are necessary within the encapsulation. In this way, a fault-resistant potentiometer which can easily be used under water is obtained.

Within the context of the present invention, it is possible, but not necessary, for the connecting apparatus to electrically connect precisely two contact points to one another. By way of example, it is also possible for the connecting apparatus to connect precisely three contact points to one another. It is also possible, but not necessary, for the connecting apparatus to permanently connect the contact points to one another. It is thus possible to use a connecting apparatus in which contact is intermittently not made with the contact point. The connecting apparatus can electrically bypass the two contact points, that is to say can connect them to a low resistance in comparison with other electrical resistances of the potentiometer, and thus act as a bypass apparatus. Alternatively, the connecting apparatus can connect the contact points by virtue of the connecting apparatus being able to be connected to an external circuit, so that a current flows through both contact points. In this case, the connecting apparatus may be in the form such that the two contact points are electrically insulated from one another when the connecting apparatus is not connected to the external circuit.

An annularly closed arrangement of the segments is understood particularly to mean that the segments arranged in this manner form an area which is not singly cohesive in the mathematical sense. By way of example, the area may be dually cohesive. To this end, it is possible, but not necessary, for the annular arrangement to have a hole in the center. Rather, it is sufficient if the segments form an annular arrangement which is such that the current in a good approximation does not flow through a center between the segments.

A current source is particularly understood to mean an apparatus which can be used to apply an electric current at a prescribed voltage or a prescribed current to two contacts.

In one preferred embodiment, the segments form a closed, particularly an annularly closed, arrangement. In this way, a rotary potentiometer is obtained which can be used to particularly good effect for measuring angles. However, it is not necessary for the segments to form a closed arrangement. Rather, it is also possible for the segments to be arranged in succession and hence to form a row.

Preferably, the potentiometer comprises electrical contacts which can be used to impress an electric current flowing through all segments. It is not necessary for the current which is impressed by the electrical contacts to flow constantly through all segments. By way of example, it is possible for the connecting apparatus in one position to bypass an entire segment, so that the electric current does not flow through this segment or flows through it only in an infinitesimally small proportion. It is particularly sufficient for there to be a position of the connecting apparatus in which the pair of electrical contacts can be used to impress an electric current which flows through all segments.

In one preferred embodiment, the contact sides are even and are situated in a common contact side plane. In other words, this means that the segments adjoin one another such that they form a continuous smooth common face. In this case, the connecting apparatus can slide over the common contact side plane particularly easily.

In one preferred embodiment, each segment adjoins precisely two neighbors flush. This results in an annularly closed arrangement. In particular, each segment in this arrangement is electrically connected to both neighbors at the sites at which they adjoin one another flush. However, it is not necessary for each segment to adjoin precisely two neighbors.

In one preferred embodiment, the segments form circular ring segments. These circular ring segments form a closed ring with a ring width which corresponds to the difference between the outer radius and the inner radius. Each circular segment then has two boundaries bent in a partial circle and two boundaries running in a straight line, with the extensions of the boundaries running in a straight line meeting at a center of the circular ring.

With particular preference, the segments are respectively of the same magnitude. As a result, a design which is particularly simple to produce is obtained. It is preferred for the specific electrical resistance in a segment to be constant. The specific electrical resistance indicates the electrical resistance which is present between two contact points of the segment at a prescribed interval. With particular preference, the specific electrical resistances of two adjacent segments are different. In this case, the magnitude of the difference is more than 10%, for example, but preferably more than 100%. It is also possible for the specific electrical resistance of two adjacent segments to be a multiple of one another.

With particular preference, the specific electrical resistance in all segments is different. This means that it is a particularly simple matter for measurements of voltages between individual segments to be used to ascertain the rotary position of the connecting apparatus.

With particular preference, the connecting apparatus bypasses precisely two contact points, so that there is a low resistance between the two contact points in comparison with other resistances of the potentiometer. The result is a particularly easily evaluatable voltage signal for ascertaining an angular position for the connecting apparatus.

With particular preference, the connecting apparatus is rotatably mounted at a center of rotation, wherein a center of rotation coincides with the circular ring center. In this way, a voltage result ascertained by the potentiometer can be particularly easily converted into an angle of rotation which the connecting apparatus has implemented around the center of rotation.

In one preferred embodiment, the connecting apparatus is designed to produce contact points for electrically connecting contact points of the segments, wherein two respective contact points are offset from the center of rotation by an angle of spread and wherein at least one angle of spread is of such magnitude that the associated contact points cannot be situated in one segment. This advantageously prevents ambiguities, which means that voltages measured on the potentiometer can always be used to explicitly ascertain the rotary position of the connecting apparatus.

Preferably, the connecting apparatus comprises a closed, flexible conductor which is arranged with respect to the electrically conductive segments such that it can be brought into electrical contact with one of the segments by pressure at a contact point. To this end, by way of example, a flexible electrical conductor is arranged at a physical interval from the contact sides of the segments. Pressure at the contact point deforms the flexible conductor and brings it into contact with the contact side of the segment. If pressure is likewise applied to the flexible conductor at a second point, the flexible conductor comes into contact with segments at two points and thus sets up electrical contact between the two. The flexible conductor preferably has a low electrical resistance. By way of example, the specific electrical resistance of the flexible conductor is low in comparison with the specific electrical resistance of the segments.

The segments and portions of the connecting apparatus, particularly the flexible conductor, are surrounded in a liquid-tight manner by a flexible jacket. This advantageously results in a liquid-tight potentiometer which can be used to produce a liquid-tight rotation sensor.

In line with the invention, the potentiometer comprises a coupling unit for applying a pressure to the flexible conductor at least two contact points. By way of example, this coupling unit is part of the connecting apparatus. By way of example the coupling device is rotatably mounted, so that twisting the coupling device results in the flexible conductor connecting the first contact point in the first segment to the second contact point in the second segment at two changing contact points. In this way, it is possible for a rotary position of the coupling device to be sensed even in liquid environments in which the segments are surrounded by a liquid-tight jacket.

In one preferred embodiment, an electrical contact is constantly arranged between two respective segments. This electrical contact can be used to tap off an electrical voltage which drops across the segment.

Preferably, the potentiometer comprises a voltage ascertainment apparatus and a controller which is designed to connect two respective contacts to a current source and two contacts to the voltage ascertainment apparatus. In this case, the controller is designed to carry out a method according to the invention, as is described further below. The contacts may be contacts connected to segments or contacts on the connecting apparatus.

In one preferred embodiment, the connecting apparatus connects the first contact point in the first segment to the second contact point in the second segment, which is different than the first segment, and precisely one third contact point. With particular preference, this third contact point is constantly situated in a third segment, which is different than the first and second segments. Of particular benefit is the use of a potentiometer according to the invention as a angle of rotation sensor in a prosthesis, such as an arm or hand prosthesis. The encapsulatability means that the prosthesis can also be used under water.

A method according to the invention preferably comprises the step of applying the electric current to a second pair of electrical contacts after a first voltage has been ascertained on the first pair of electrical contacts.

This means that the method can be performed with just one current source and just one voltage ascertainment apparatus. In particular, the method comprises ascertaining output voltages between output pairs of electrical contacts, wherein $n>1$ and wherein the n pairs are chosen such that each rotary position of the connecting apparatus corresponds to precisely one combination of the output voltages. This means that the rotary position of the connecting apparatus can be explicitly associated from the measured voltages.

The potentiometer according to the invention may have a connecting apparatus which is in contact with the segments at two, three, four or five contact points. Embodiments of particularly simple design require no more than two or three contact points, however.

Figure 1A:
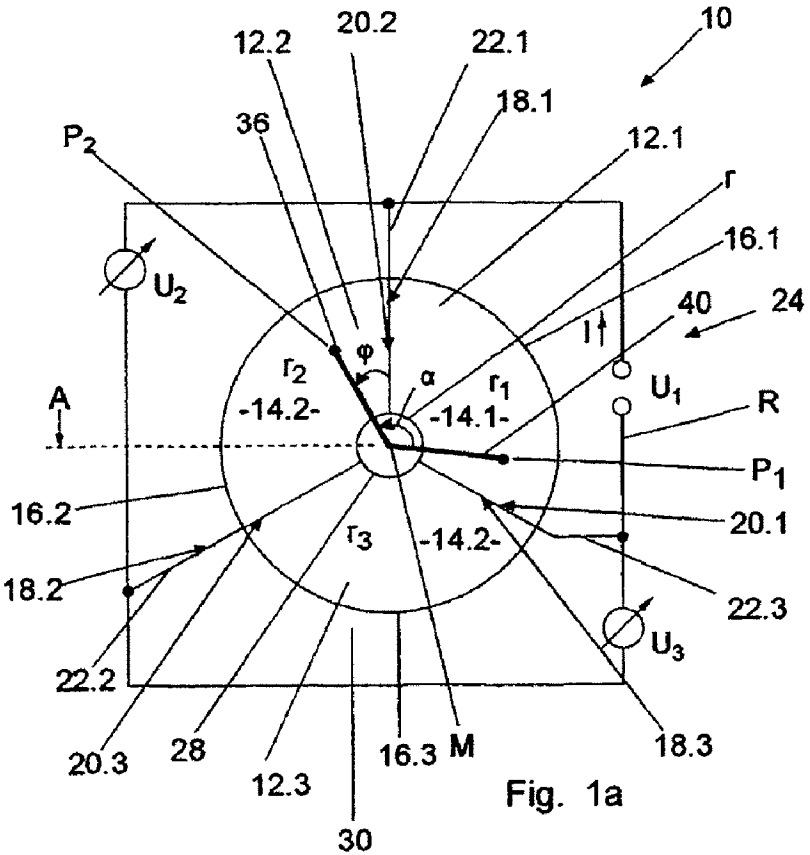

Exemplary embodiments of the invention are described in more detail below with reference to the appended drawings, in which FIG. 1*a* shows a schematic view of a first potentiometer according to the invention with three segments and a connecting apparatus in a first position, FIG. 1*b* shows an equivalent circuit diagram of the potentiometer shown in FIG. 1*a*.

Figure 2B:
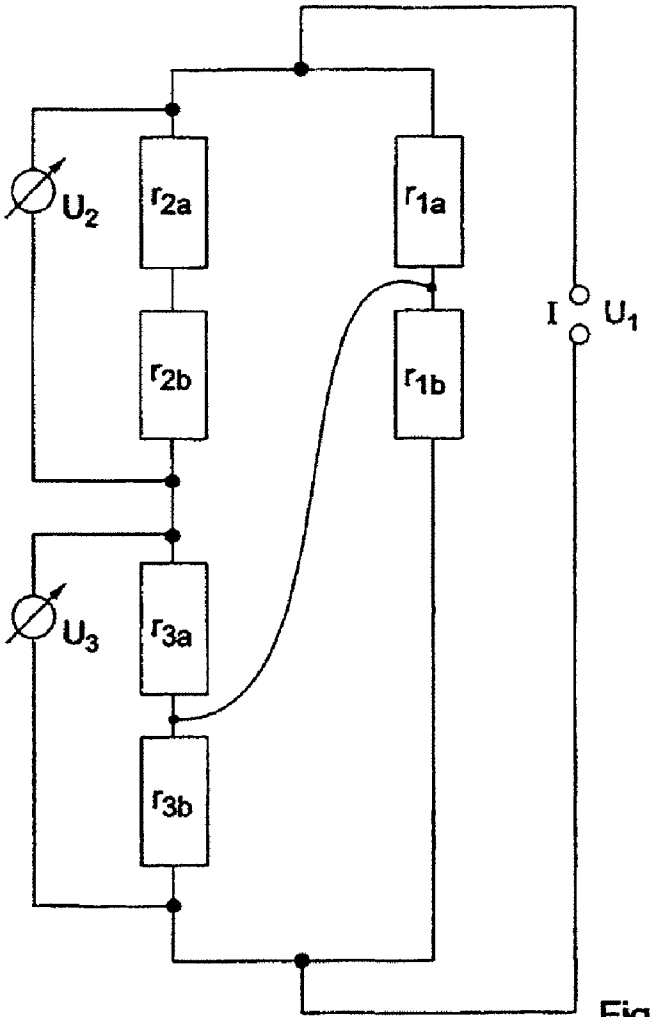
Figure 2A:
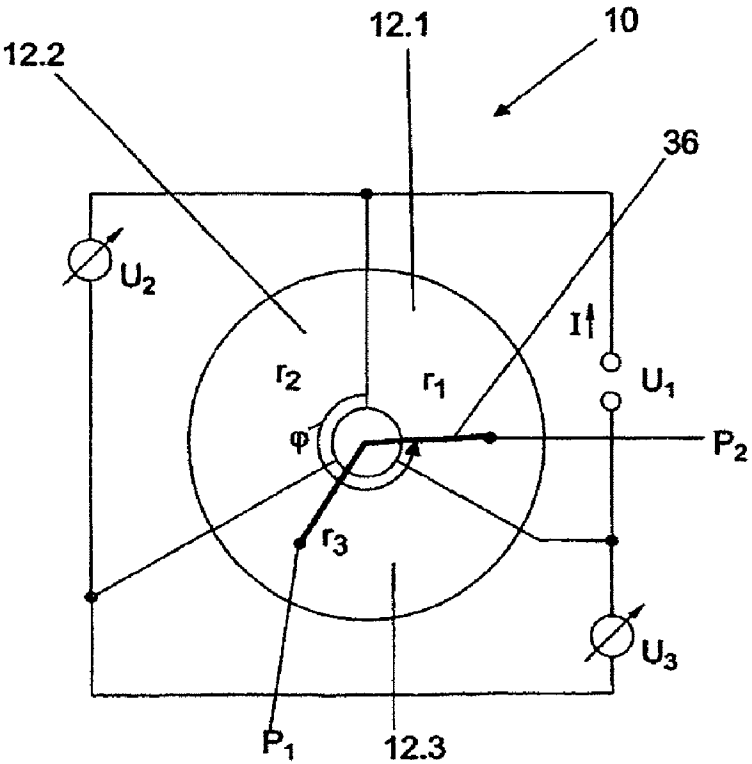

FIG. 2*a* shows the potentiometer shown in FIG. 1*a* with a different position for the connecting apparatus, FIG. 2*b* shows the equivalent circuit diagram for the potentiometer with the position shown in FIG. 2*a*.

Figure 3B:
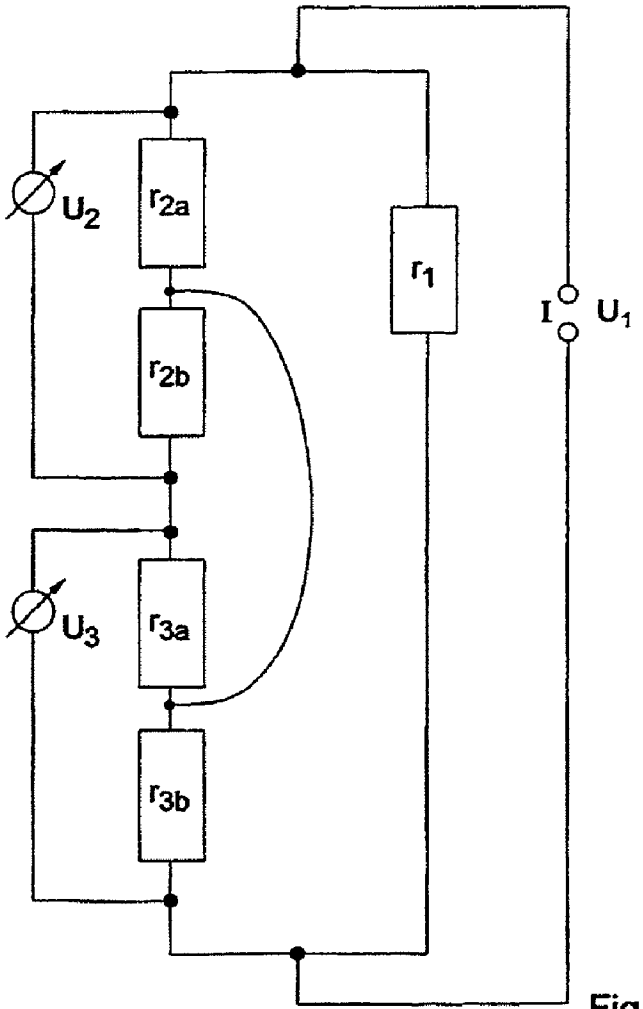
Figure 3A:
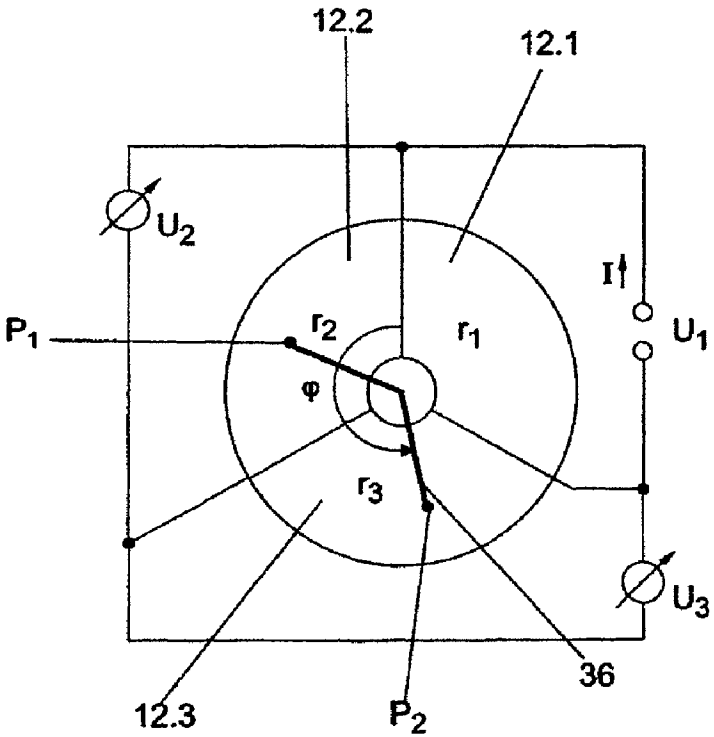

FIG. 3*a* shows the potentiometer from FIGS. 1*a* and 2*a* with a third position for the connecting apparatus, and FIG. 3*b* shows the equivalent circuit diagram associated with FIG. 3*a*.

Figure 4A:
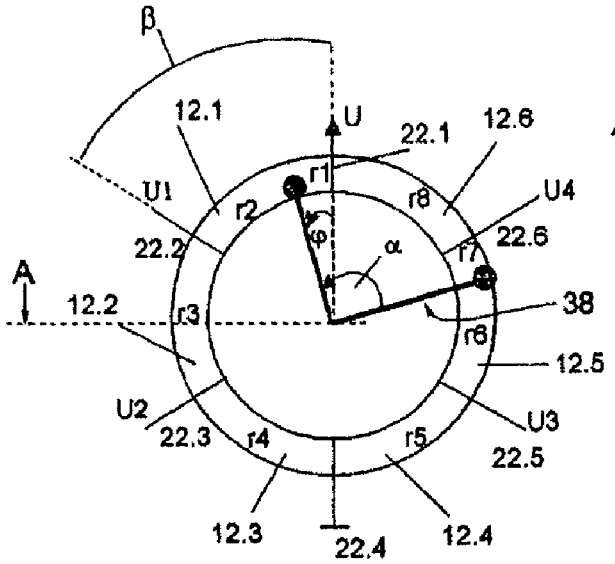
Figure 4B:
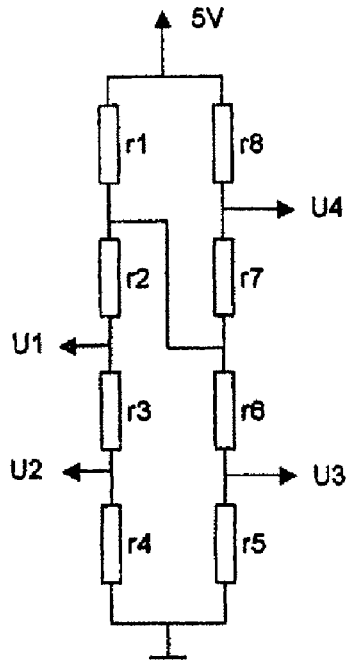

FIG. 4*a* shows a second embodiment of a potentiometer according to the invention with six segments, in which the connecting apparatus is in a first position, and FIG. 4*b* shows the associated equivalent circuit diagram.

Figure 5A:
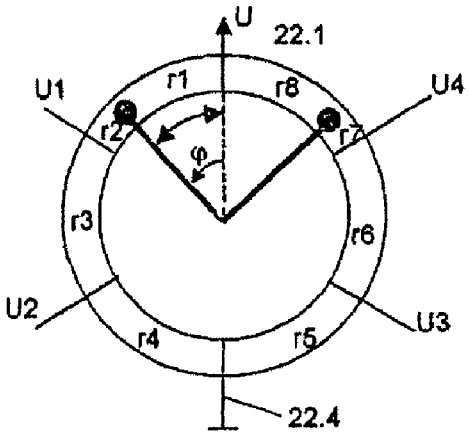
Figure 5B:
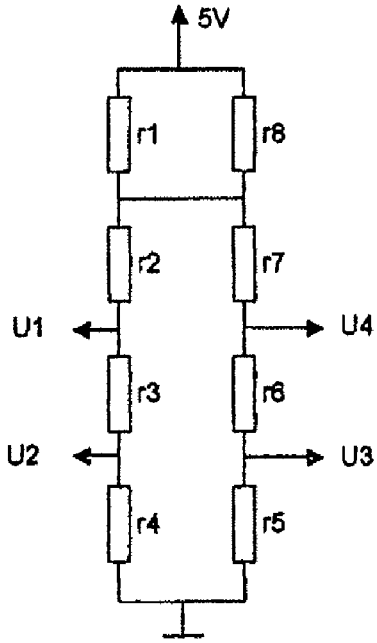

FIG. 5*a* shows the potentiometer shown in FIG. 4*a*, in which the connecting apparatus is in a second position, and FIG. 5*b* shows the associated equivalent circuit diagram.

Figure 6A:
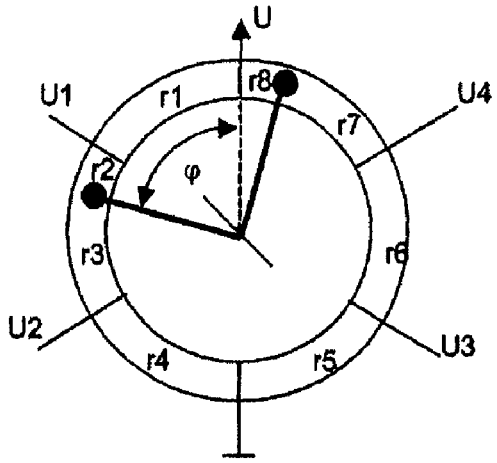
Figure 6B:
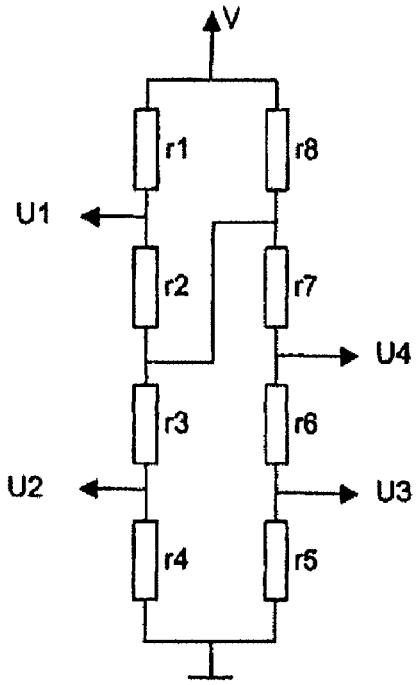

FIG. 6*a* shows the potentiometer shown in FIG. 4*a*, in which the connecting apparatus is in a third position, and FIG. 6*b* shows the associated equivalent circuit diagram.

Figure 7A:
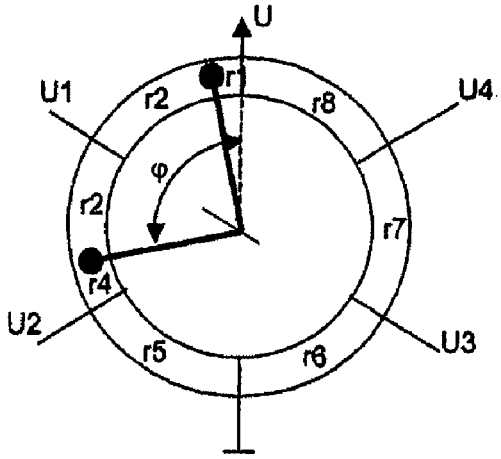
Figure 7B:
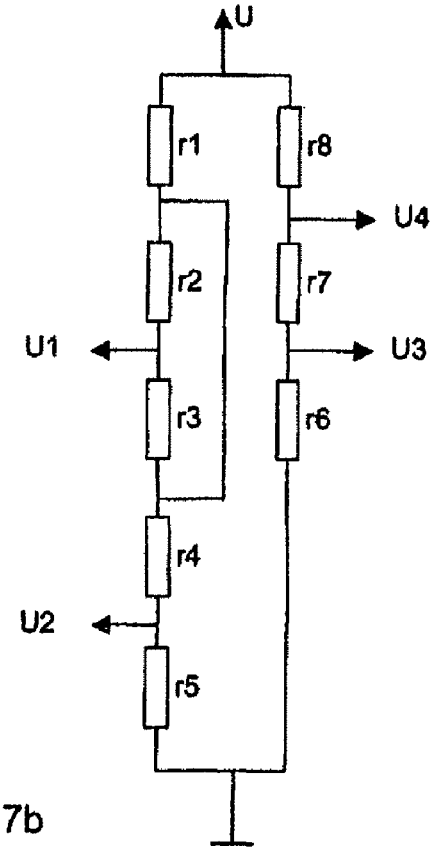

FIG. 7*a* shows the potentiometer shown in FIG. 4*a*, in which the connecting apparatus is in a fourth position, and FIG. 7*b* shows the associated equivalent circuit diagram.

Figure 8A:
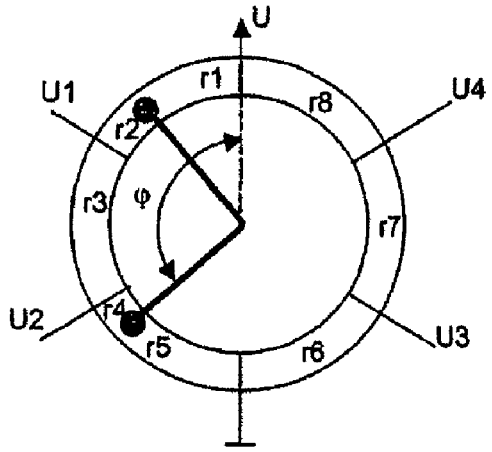
Figure 8B:
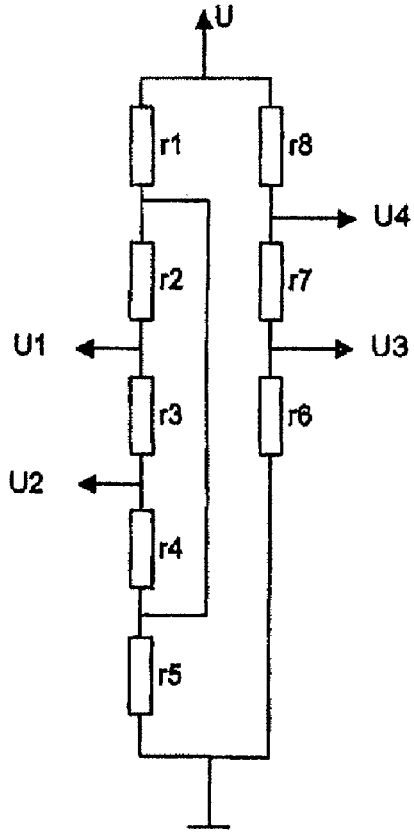

FIG. 8*a* shows the potentiometer shown in FIG. 4*a*, in which the connecting apparatus is in a fifth position, and FIG. 8*b* shows the associated equivalent circuit diagram.

Figure 9A:
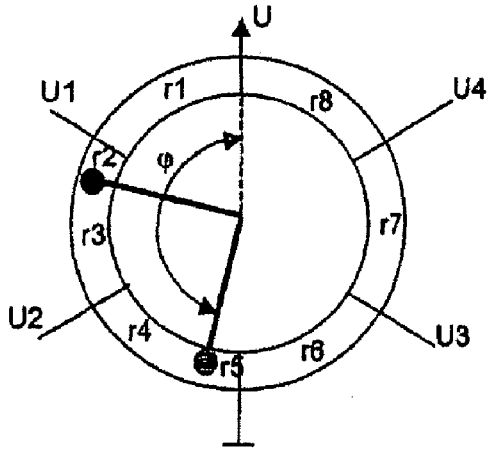
Figure 9B:
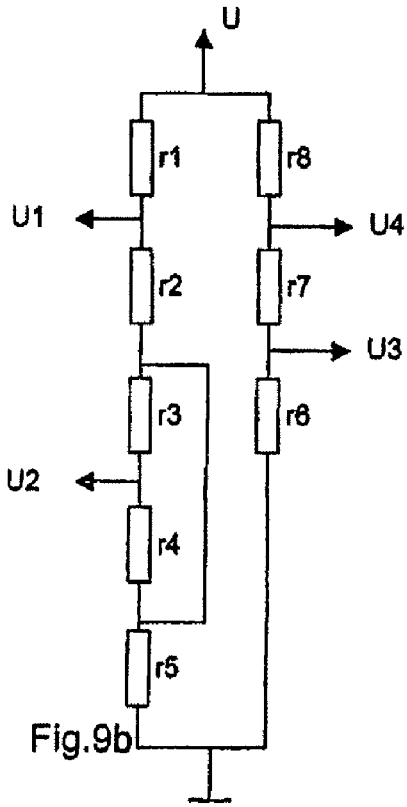

FIG. 9*a* shows the potentiometer shown in FIG. 4*a*, in which the connecting apparatus is in a sixth position, and FIG. 9*b* shows the associated equivalent circuit diagram.

Figure 10A:
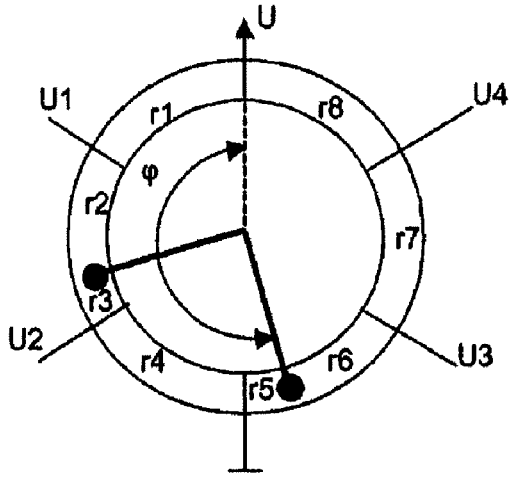
Figure 10B:
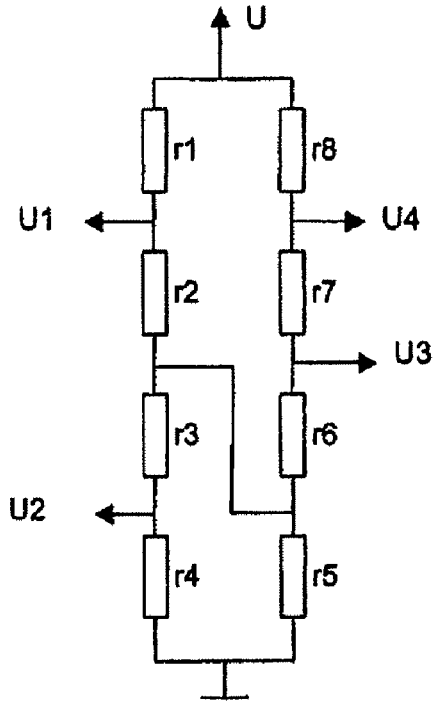

FIG. 10*a* shows the potentiometer shown in FIG. 4*a*, in which the connecting apparatus is in a seventh position, and FIG. 10*b* shows the associated equivalent circuit diagram.

Figure 11A:
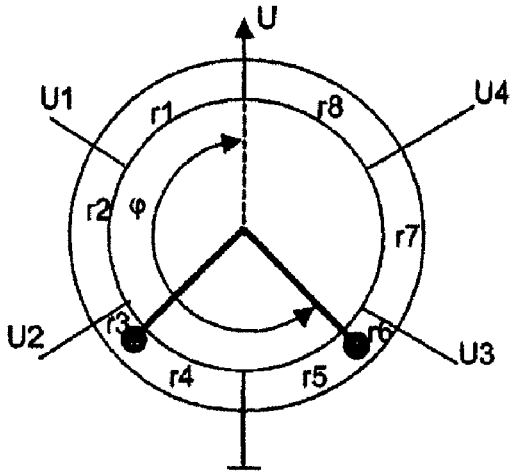
Figure 11B:
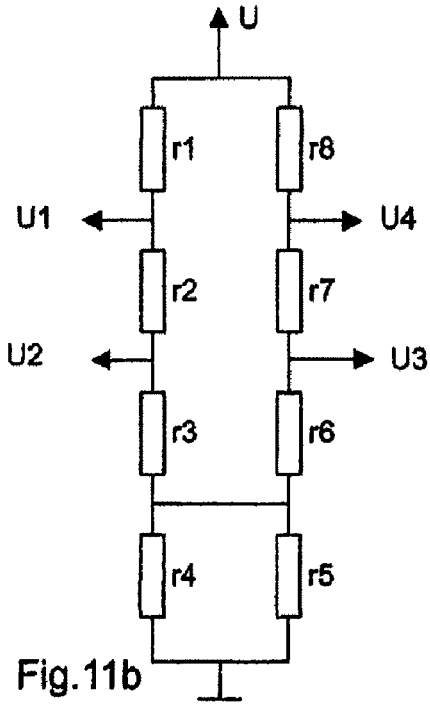

FIG. 11*a* shows the potentiometer shown in FIG. 4*a*, in which the connecting apparatus is in an eighth position, and FIG. 11*b* shows the associated equivalent circuit diagram.

Figure 12A:
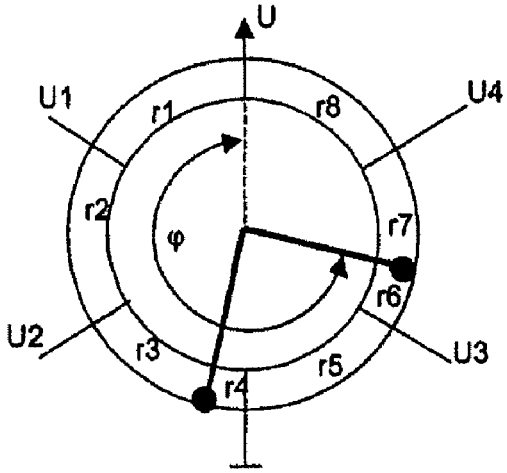
Figure 12B:
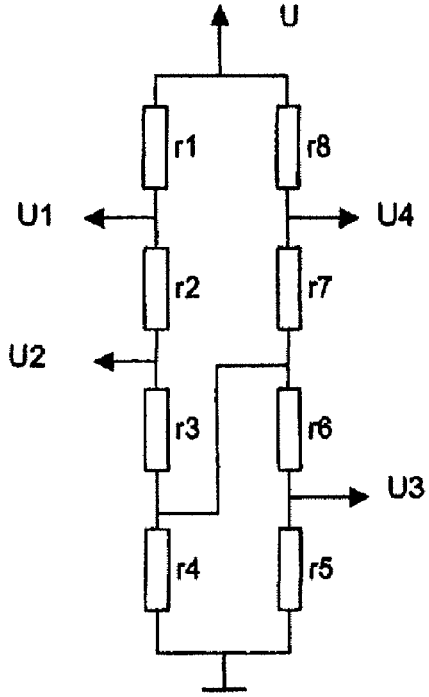

FIG. 12*a* shows the potentiometer shown in FIG. 4*a*, in which the connecting apparatus is in a ninth position, and FIG. 12*b* shows the associated equivalent circuit diagram.

Figure 13A:
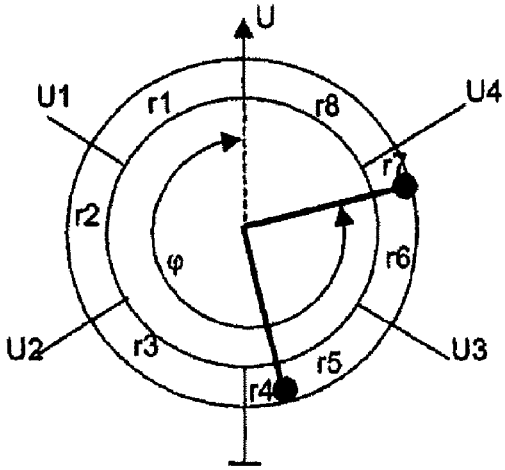
Figure 13B:
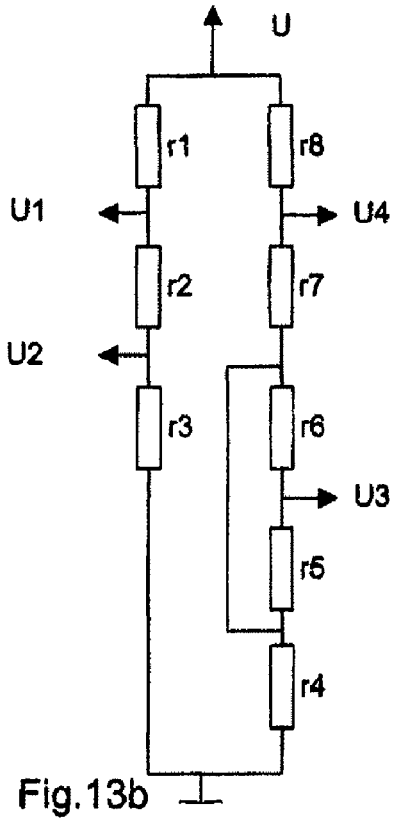

FIG. 13*a* shows the potentiometer shown in FIG. 4*a*, in which the connecting apparatus is in a tenth position, and FIG. 13*b* shows the associated equivalent circuit diagram.

Figure 14A:
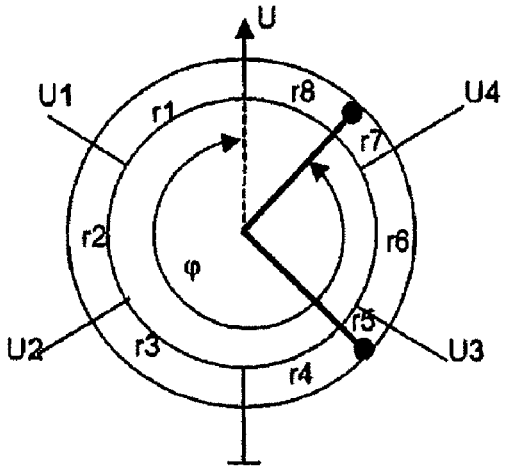
Figure 14B:
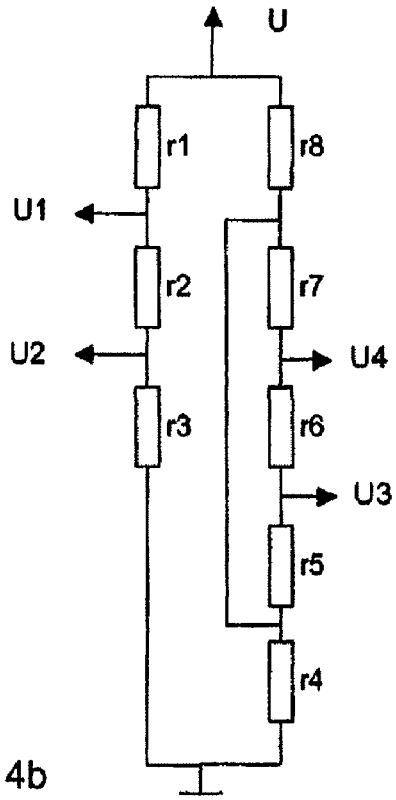

FIG. 14*a* shows the potentiometer shown in FIG. 4*a*, in which the connecting apparatus is in an eleventh position, and FIG. 14*b* shows the associated equivalent circuit diagram.

Figure 15A:
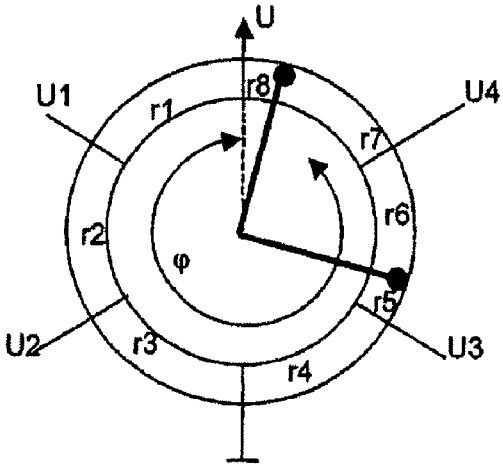
Figure 15B:
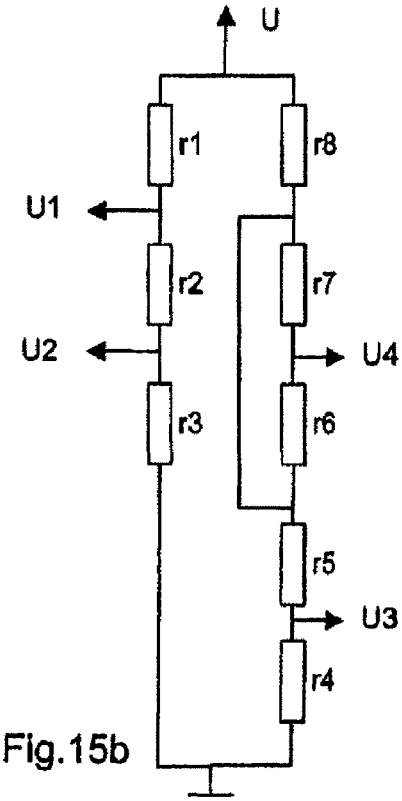

FIG. 15*a* shows the potentiometer shown in FIG. 4*a*, in which the connecting apparatus is in a twelfth position, FIG. 15*b* shows the associated equivalent circuit diagram.

Figure 16A:
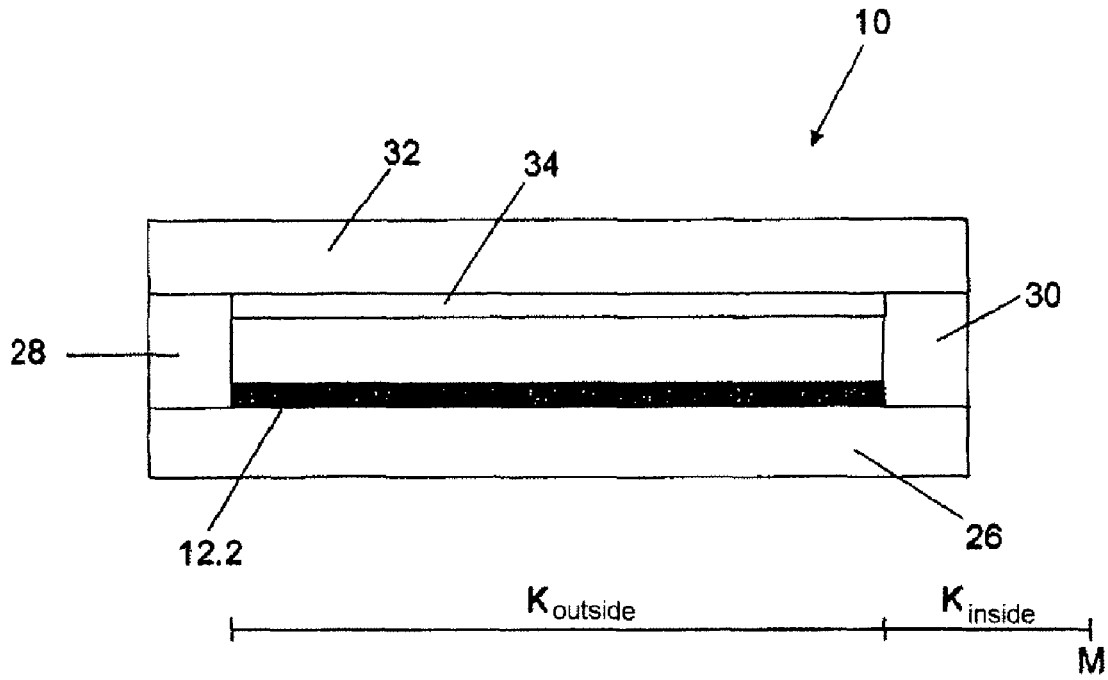
Figure 16B:
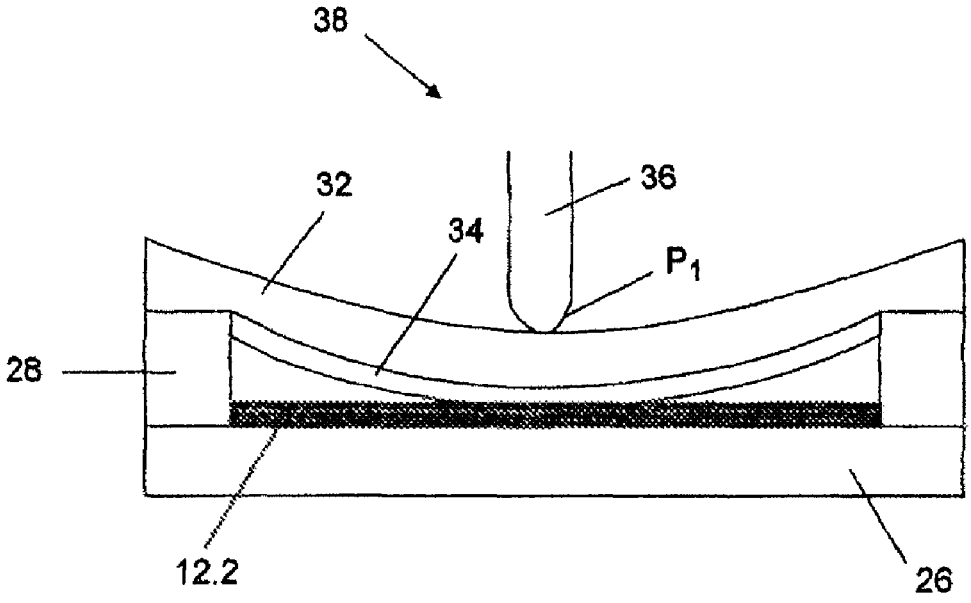

FIGS. 16*a* and 16*b* show a cross-section along line A in FIGS. 1*a* and 4*a*.

FIGS. 17*a*,17*b*, 18*a*,18*b*, 19*a*,19*b*, 20*a*,20*b*, 21*a*,21*b*, and 22*a*,22*b* show a third embodiment of a potentiometer according to the invention and the respective associated equivalent circuit diagrams.

Figure 23A:
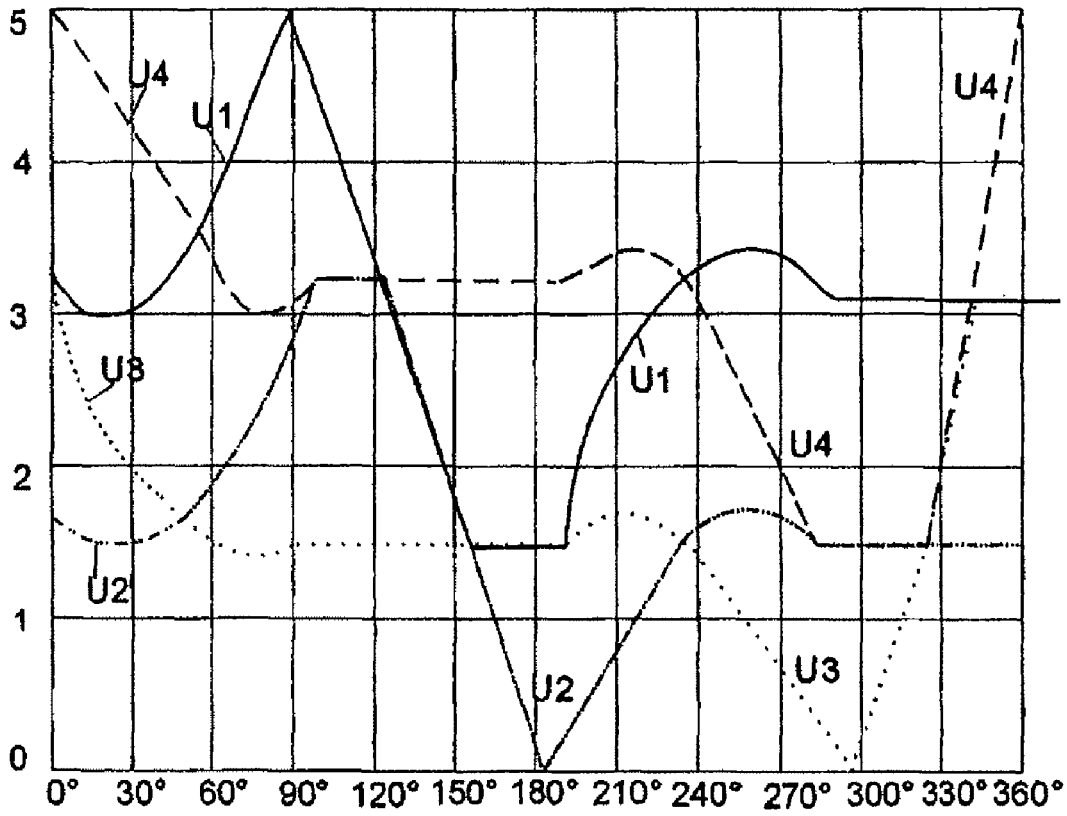
Figure 23B:
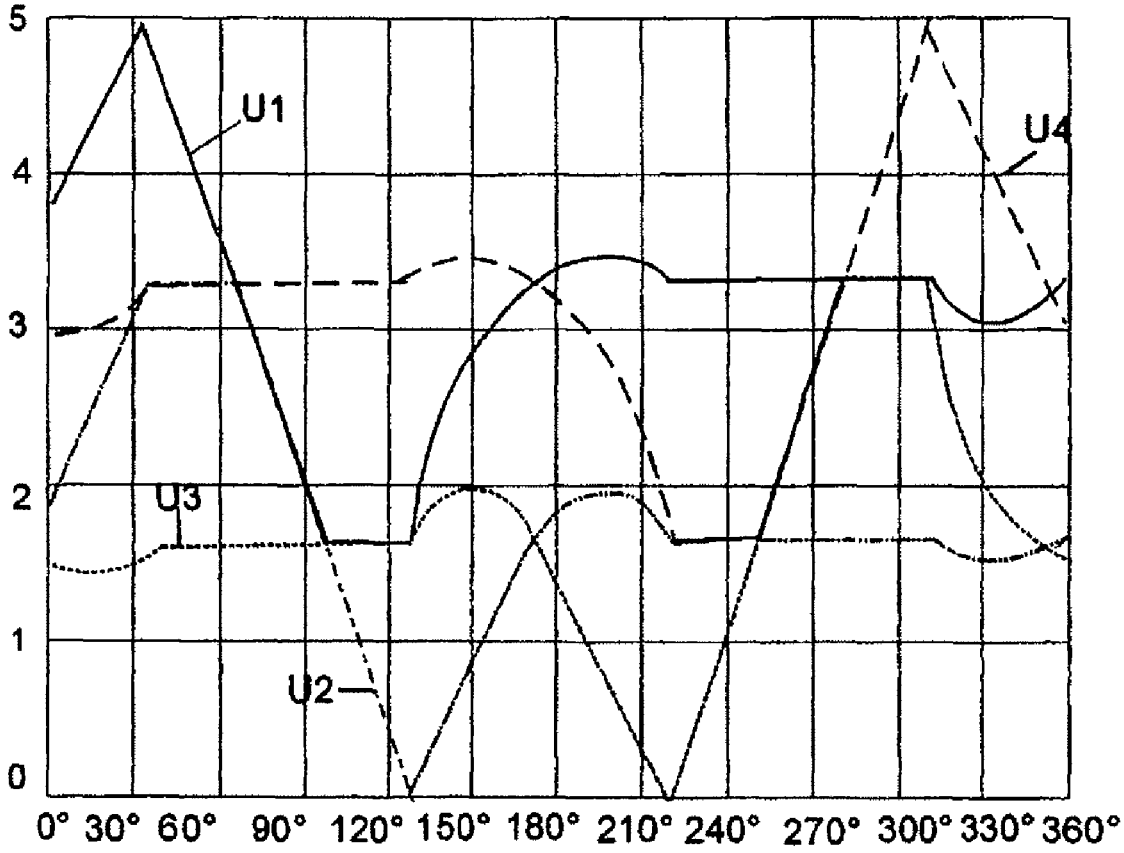

FIGS. 23*a* and 23*b* are graphs showing the dependency of voltage drops on contacts of the potentiometer shown in FIGS. 4*a* to 15*b* on the angle of rotation of the connecting apparatus.

Figure 24:
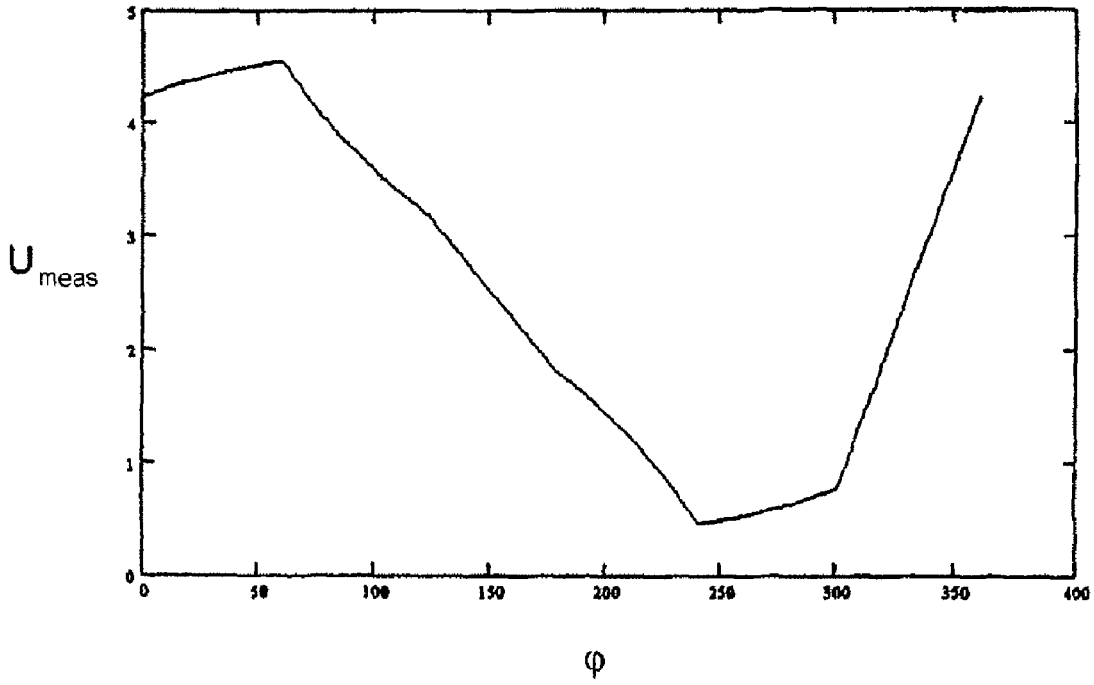

FIG. 24 is a curve profile, resulting from part-calculations, of the voltage over 360° of the angle of rotation for a potentiometer as shown in FIGS. 17*a* to 22*b*.

FIG. 1*a* shows a potentiometer 10 with three segments 12.1, 12.2, 12.3 which respectively have a contact side 14.1, 14.2 and 14.3. The contact side 14.1 is delimited by an edge 16.1 which runs around the segment 12.1 once. In this same way, the contact side 14.2 is delimited by an edge 16.2 and the contact side 14.3 is delimited by an edge 16.3. Objects of similar type respectively bear the same reference symbols with possibly different suffixes used for consecutive numbering.

The edge 16.1 has a first section 18.1 and a second section 20.1. In the same way, the edges 16.2 and 16.3 have first sections 18.1 and 18.3 and second sections 20.2 and 20.3. The segments 12.1, 12.2 and 12.3 have their first sections 18 and their second sections 20 adjacent to one another in each case flush, so that they are in electrical contact with one another. The adjacency means that the segments 12.1 to 12.3, which are in the form of circular ring segments, form a closed circular ring in which each segment is electrically connected to precisely two adjacent segments on the basis of their flush contact.

The segments 12.1, 12.2 and 12.3 are respectively of the same magnitude and have a homogeneous—that is to say independent of locations—specific electrical resistance. Thus, the segment 12.1 has a specific electrical resistance $r_1$ which differs from a specific electrical resistance $r_2$ for segment 12.2 and a specific electrical resistance $r_3$ for segment 12.3.

Two respective segments have an electrical contact situated between them. Thus, an electrical contact 22.1 is situated between the segments 12.1 and 12.2. An electrical contact 22.2 is arranged between the segments 12.2 and 12.3 and an electrical contact 22.3 is arranged between the segments 12.3 and 12.1. The electrical contacts 22.1 to 22.3 can be used to ascertain a voltage which drops across the respective segment. In one alternative embodiment, the contacts 22 may also be arranged at any other points on the segments, for example in the respective segment center.

The electrical contacts 22.1, 22.3 can be used to impress a prescribed current I which can be output by a current source 24.1. Alternatively, a voltage source 24.2 is provided which applies a prescribed voltage $U_1$ of 5V, for example, to the electrical contacts 22.1 and 22.3.

The segments 12.1 to 12.3 shown in FIG. 1 form a position for the potentiometer 10. FIG. 16*a* shows a section along the line A. As can be seen, the potentiometer 10 comprises a support 26 on which the segments 12.1 to 12.3 are fitted, with FIG. 16*a* showing only the segment 12.2. Along an outer circular ring radius $K_{outside}$ and an inner circular ring radius $K_{inside}$, there are arranged an inner spacing ring 28 and an outer spacing ring 30 which hold a covering membrane 32 at an interval from the support 26. The covering membrane 32 has a flexible conductor 34 mounted on it in the form of a silver layer which is of circular-ring-shaped design and is at an interval from the segments 12.1 to 12.3.

As FIG. 16*b* shows, pressure by means of a coupling device 36 on the covering membrane 32 results in the flexible conductor 34 being deformed and thus coming into contact with the respective segment, in this case with segment 12.2, at a contact point. This sets up electrical contact between the flexible conductor 34 and the segment 12.2. The covering membrane 32, the flexible conductor 34 and the coupling device 36 are parts of a connecting apparatus 38. Alternatively, the connecting apparatus may also comprise known wiper contacts which are rotatably mounted.

FIG. 1*a* shows the coupling device 36, which is mounted at a center M so as to be able to rotate around an angle of rotation $\phi$. At its ends the coupling device 36 exerts pressure at two contact points $P_1$, $P_2$ onto the covering membrane 32 (FIG. 16*b*) and thus shorts the relevant segments, in FIG. 1*a* the segments 12.1 and 12.2, at the contact points $P_1$, and $P_2$. As explained in more detail further below, this alters the voltage which drops between two segments.

The two contact points $P_1$ and $P_2$ are spaced apart from one another with respect to the center M by an angle of spread $\alpha$ (FIG. 1*a*) which is greater than the angle range spanned by a segment, in the present case 120°.

FIG. 1*b* shows the equivalent circuit diagram, associated with the angle of rotation $\phi$, for the potentiometer 10. The electrical resistance of each segment 12.1 to 12.3 is divided into two resistance elements which represent the electrical resistance clockwise before the contact point $P_1$, $P_2$ and thereafter. The sum of the resistance elements, which are denoted by the suffix "a" or "b", respectively corresponds to the total resistance r of the segment. The magnitude of each of the resistance elements is dependent on the angle of rotation $\phi$, provided that one of the two contact points $P_1$ and $P_2$ is situated in the relevant segment.

The equivalent circuit diagram shown in FIG. 1*b* can be used to ascertain the voltages $U_1$, $U_2$ and $U_3$ by applying Kirchhoff's rules, said voltages dropping across the segments 12.1, 12.2 and 12.3 for a prescribed current I or a prescribed voltage and being able to be measured using the electrical contacts 22.1, 22.2 and 22.3. When a prescribed voltage $U_1$ is applied, the voltages $U_2$ and $U_3$ can be calculated accordingly.

FIG. 2*a* shows the potentiometer 10, in which the coupling device 36 is at another angle of rotation A, which means that the contact point $P_1$ is situated in the segment 12.3 and the contact point $P_2$ is situated in the segment 12.1. The equivalent circuit diagram shown in FIG. 2*b* is obtained.

FIG. 3*a* shows a third possible position for the coupling device 36, in which the first contact point $P_1$ is situated in the segment 12.2 and the second contact point $P_2$ is situated in the segment 12.3. The equivalent circuit diagram shown in FIG. 3*b* is obtained.

The equivalent circuit diagrams shown in FIGS. 1*b*, 2*b* and 3*b* can be used to ascertain, for a prescribed current I or prescribed voltage U, a pair, comprising first voltage $U_1$ and second voltage $U_2$, for each angle of rotation $\phi$ shown, which pair corresponds uniquely to the angle of rotation $\phi$. By ascertaining two of the three voltages $U_1$, to $U_3$, it is therefore possible to explicitly infer the angle of rotation $\phi$.

FIG. 4*a* shows a second embodiment of a potentiometer 10 according to the invention with six segments 12.1, 12.2, 12.3, 12.4, 12.5 and 12.6. The segments 12.1 to 12.6 are arranged as described above for the first embodiment. Between the individual segments, there are arranged electrical contacts 22.1 to 22.6. The contacts 22.1 and 22.4 are connected to a voltage source—not shown—which uses the two electrical contacts to apply an electrical voltage V of 5 V for example, which results in a current I which flows through all segments 12.1 to 12.6. FIG. 4*b* shows the equivalent circuit diagram for the potentiometer 10 when the coupling device 36 is in the position shown in FIG. 4. The resistances are in turn indicated by $R_i$, where i=1, 2, 3, 4, 5, 6.

FIGS. 5*a*,5*b*, 6*a*,6*b*, 7*a*,7*b*, 8*a*,8*b*, 9*a*,9*b*, 10*a*,10*b*, 11*a*,11*b*, 12*a*,12*b*, 13*a*,13*b*, 14*a*,14*b* and 15*a*,15*b* respectively show the further possible positions for the coupling device 36 and the associated equivalent circuit diagrams. In connection with the description of FIGS. 23*a*,23*b*, it is deduced further below which voltages can be measured between individual electrical contacts 22.1 to 22.6 for different angles of rotation $\phi$.

Figure 17B:
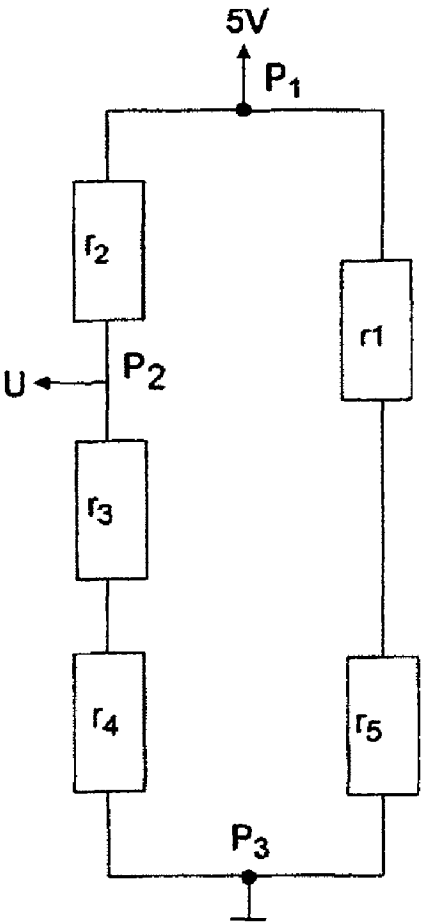
Figure 17A:
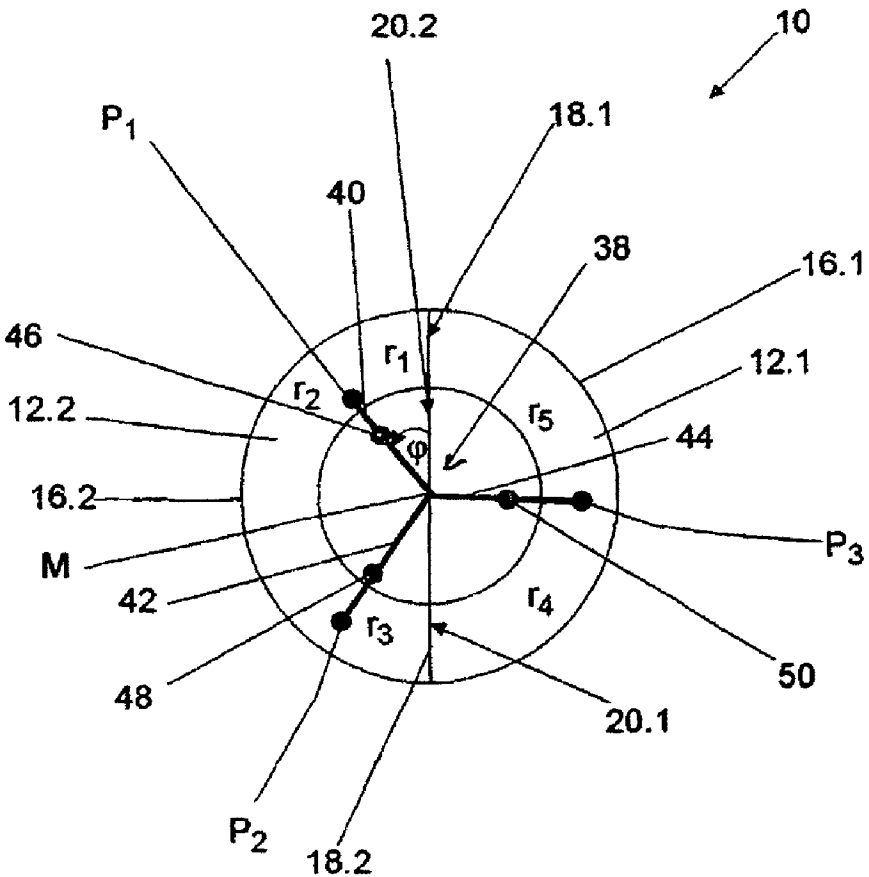

FIG. 17*a* shows an alternative embodiment of a potentiometer 10 according to the invention which has two segments 12.1 and 12.2 which have edges 16.1 and 16.2. The edges 16.1 and 16.2 adjoin one another flush at their respective first sections 18.1 and 18.2, on the one hand, and their second sections 20.1 and 20.2 on the other, such that they are in electrical contact with one another.

The two segments 12.1, 12.2 form a circular-ring-shaped arrangement at whose center M a connecting apparatus 38 is mounted so as to be able to rotate around the center M. The connecting apparatus 38 has a first arm 40, a second arm 42 and a third arm 44 which are in electrical contact with the respective segment at their end which is remote from the center M at a first contact point $P_1$, at a second $P_2$ and at a third contact point $P_3$. In this way, wiper contacts are formed.

A first current-flow contact 46 and a second current-flow contact 48 are used by a current source—not shown—to impress an electric current I which comes from the current source and flows via the first arm 40 through the contact point $P_1$, through the segment 12.1 or through the segments 12.1 and 12.2, through the contact point $P_2$ and the second arm 42 back to the current source. The first arm 40 is electrically insulated from the second arm 42, so that a flow of current from the first current-flow contact to the second current-flow contact is not possible through the two arms 40, 42 alone. Alternatively, instead of the electric current I, it is also possible to apply an electrical voltage U to the two current-flow contacts 46, 48.

On the basis of the electric current described above, an electrical voltage is formed between the contact points $P_3$ and $P_1$ and the contact points $P_3$ and $P_2$ and can be measured by a voltage measurement apparatus—not shown. To this end, the voltage is measured between the measurement contact 50 and the first current-flow contact and the second current-flow contact 48, respectively.

FIG. 17*b* shows the equivalent circuit diagram for the potentiometer shown in FIG. 17*a*, with the angle of rotation position $\phi$ shown therein. The notation for the resistances corresponds to the notation for the two exemplary embodiments described above.

Figure 18A:
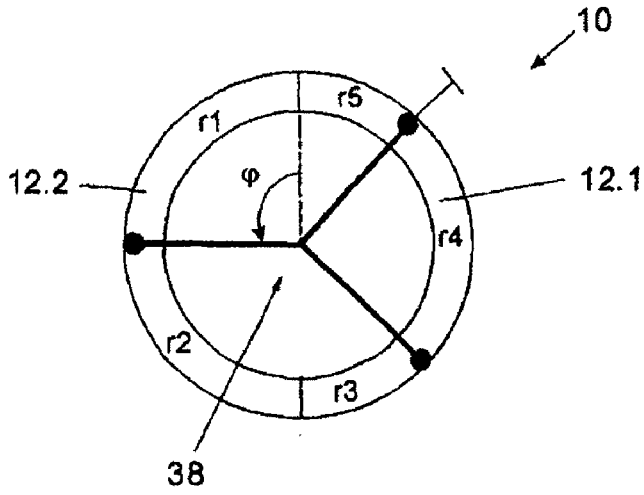
Figure 18B:
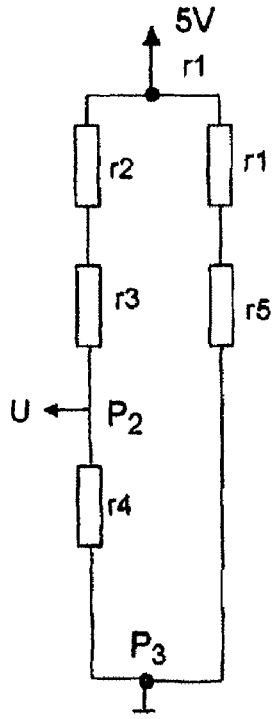

FIG. 18*a* shows the potentiometer in another annular position and FIG. 18*b* shows the associated equivalent circuit diagram.

FIGS. 19*a*,19*b*, 20*a*,20*b*, 21*a*,21*b*, and 22*a*,22*b* show further possible positions of the transmission apparatus 38 and the respective equivalent circuit diagrams.

Calculation of the Measured Voltages on the Basis of the Angle of Rotation for the Second Embodiment From the equivalent circuit diagrams shown in FIGS. 17*b*, 18*b*, 19*b*, 20*b*, 21*b* and 22*b*, it is possible to calculate, for a prescribed current I, the voltages measured between the first contact point $P_1$ and the third contact point $P_3$ and between the second contact point $P_2$ and the third contact point $P_3$, as follows.

For the calculations, an angle of spread $\alpha$ between the two operating elements is assumed to be 90°. For the resistance per unit length, a value of 10Ω per degree (°) is assumed. Each segment 12.1 to 12.6 covers 60°, which means that the resistance of a segment is 600 Ω.

If, as per FIG. 4*a*, a voltage is applied between the connections 22.1 (U=+5V) and 22.4 (ground) and the angle $\phi$ changes between 0° and 30°, an equivalent circuit as shown in FIG. 4*b* is obtained.

The resistance elements in FIG. 4*b* are calculated as follows:

$r1=\phi*10\ \Omega$ $r2=(60-\phi)*10\ \Omega$ $r3=600\ \Omega$ $r4=600\ \Omega$ $r5=600\ \Omega$ $r6=(30+\phi)*10\ \Omega$ $r7=(30-\phi)*10\ \Omega$ $r8=600\ \Omega$ Kirchhoff's laws are used to obtain the voltage profile—shown in FIG. 23*a* in the range $0°\leqq\phi\leqq30°$—for the voltages U1 between the contact 22.2 and ground, U2 between the contact 22.3 and ground, U3 between the contact 22.5 and ground and U4 between the contact 22.6 and ground.

If a voltage U is applied between the connections 22.1 (+5V) and 22.4 (ground) and the angle $\phi$ is changed between 30° and 60° as shown in FIG. 5*a*, an equivalent circuit as shown in FIG. 5*b* is obtained. The resistance elements in FIG. 5*b* are calculated as follows:

$r1=\phi*10\ \Omega$ $r2=(60-\phi)*10\ \Omega$ $r3=600\ \Omega$ $r4=600\ \Omega$ $r5=600\ \Omega$ $r6=600\ \Omega$ $r7=(\phi-30)*10\ \Omega$ $r8=(90-\phi)*10\ \Omega$ Kirchhoff's laws are used to obtain the voltage profile shown in FIG. 23*a* in the range $30°\leqq\phi\leqq60°$.

If the angle $\phi$ is changed between 60° and 90° as shown in FIG. 6*a*, an equivalent circuit as shown in FIG. 6*b* is obtained. The resistance elements in FIG. 6*b* are calculated as follows:

$r1=600\ \Omega$ $r2=(\phi-60)*10\ \Omega$ $r3=(120-\phi)*10\ \Omega$ $r4=600\ \Omega$ $r5=600\ \Omega$ $r6=600\ \Omega$ $r7=(\phi-30)*10\ \Omega$ $r8=(90-\phi)*10\ \Omega$ Kirchhoff's laws are used to obtain the voltage profile shown in FIG. 23*a* in the range $60°\leqq\phi\leqq90°$.

If the angle $\phi$ is changed between 90° and 120° as shown in FIG. 7*a*, an equivalent circuit as shown in FIG. 7*b* is obtained. The resistance elements in FIG. 7*b* are calculated as follows:

$r1=(\phi-90)*10\ \Omega$ $r2=(150-\phi)*10\ \Omega$ $r3=(\phi-60)*10\ \Omega$ $r4=600\ \Omega$ $r5=600\ \Omega$ $r6=600\ \Omega$ $r7=(\phi-30)*10\ \Omega$ $r8=(90-\phi)*10\ \Omega$ Kirchhoff's laws are used to obtain the voltage profile shown in FIG. 23*a* in the range $90°\leqq\phi\leqq120°$.

If the angle $\phi$ is changed between 120° and 150° as shown in FIG. 8*a*, an equivalent circuit as shown in FIG. 8*b* is obtained. The resistance elements in FIG. 8*b* are calculated as follows:

$r1=(\phi-90)*10\ \Omega$ $r2=(150-\phi)*10\ \Omega$ $r7=(\phi-120)*10\ \Omega$ $r3=(180-\phi)*10\ \Omega$ $r5=600\ \Omega$ $r6=600\ \Omega$ $r7=600\ \Omega$ $r8=600\ \Omega$ Kirchhoff's laws are used to obtain the voltage profile shown in FIG. 23*a* in the range $120°\leqq\phi\leqq150°$.

If the angle $\phi$ is changed between 120° and 180° as shown in FIG. 9*a*, an equivalent circuit as shown in FIG. 9*b* is obtained. The resistance elements in FIG. 9*b* are calculated as follows:

$r1=600\ \Omega$ $r2=(\phi-150)*10\ \Omega$ $r3=(210-\phi)*10\ \Omega$ $r4=(\phi-120)*10\ \Omega$ $r5=(180-\phi)*10\ \Omega$ $r6=600\ \Omega$ $r7=600\ \Omega$ $r8=600\ \Omega$ Kirchhoff's laws are used to obtain the voltage profile shown in FIG. 23*a* in the range $150°\leqq\phi\leqq180°$.

If the angle $\phi$ is changed between 180° and 210° as shown in FIG. 10*a*, an equivalent circuit as shown in FIG. 10*b* is obtained. The resistance elements in FIG. 10*b* are calculated as follows:

$r1=600\ \Omega$ $r2=(\phi-150)*10\ \Omega$ $r3=(210-\phi)*10\ \Omega$ $r4=600\ \Omega$ $r5=(\phi-180)*10\ \Omega$ $r6=(240-\phi)*10\ \Omega$ $r7=600\ \Omega$ $r8=600\ \Omega$ Kirchhoff's laws are used to obtain the voltage profile shown in FIG. 23*a* in the range $180° \leqq \phi \leqq 210°$.

If the angle $\phi$ is changed between 210° and 240° as shown in FIG. 11*a*, an equivalent circuit as shown in FIG. 11*b* is obtained. The resistance elements in FIG. 11*b* are calculated as follows:

$r1=600\ \Omega$ $r2=600\ \Omega$ $r3=(\phi-210)*10\ \Omega$ $r4=(270-\phi)*10\ \Omega$ $r5=(\phi-180)*10\ \Omega$ $r6=(240-\phi)*10\ \Omega$ $r7=600\ \Omega$ $r8=600\ \Omega$ Kirchhoff's laws are used to obtain the voltage profile shown in FIG. 23*a* in the range $210° \leqq \phi \leqq 240°$.

If a voltage is applied between the connections 22.1 (+5V) and 22.4 (ground) as shown in FIG. 4*a*, and the angle $\phi$ is changed between 240° and 270° as shown in FIG. 12*a*, an equivalent circuit as shown in FIG. 12*b* is obtained. The resistance elements in FIG. 12*b* are calculated as follows:

$r1=600\ \Omega$ $r2=600\ \Omega$ $r3=(\phi-210)*10\ \Omega$ $r4=(270-\phi)*10\ \Omega$ $r5=600\ \Omega$ $r6=(\phi-240)*10\ \Omega$ $r7=(300-\phi)*10\ \Omega$ $r8=600\ \Omega$ Kirchhoff's laws are used to obtain the voltage profile shown in FIG. 23*a* in the range $240° \leqq \phi \leqq 270°$.

If a voltage is applied between the connections 22.1 (+5V) and 22.4 (ground) as shown in FIG. 4*a*, the angle $\phi$ is changed between 270° and 300° as shown in FIG. 13*a*, an equivalent circuit as shown in FIG. 13*b* is obtained.

The resistance elements in FIG. 13*b* are calculated as follows:

$r1=600\ \Omega$ $r2=600\ \Omega$ $r3=600\ \Omega$ $r4=(\phi-270)*10\ \Omega$ $r5=(350-\phi)*10\ \Omega$ $r6=(\phi-240)*10\ \Omega$ $r7=(300-\phi)*10\ \Omega$ $r8=600\ \Omega$ Kirchhoff's laws are used to obtain the voltage profile shown in FIG. 23*a* in the range $270° \leqq \phi \leqq 300°$.

If the angle $\phi$ is changed between 300° and 330° as shown in FIG. 14*a*, an equivalent circuit as shown in FIG. 14*b* is obtained. The resistance elements in FIG. 14*b* are calculated as follows:

$r1=600\ \Omega$ $r2=600\ \Omega$ $r3=600\ \Omega$ $r4=(\phi-180)*10\ \Omega$ $r5=(270-\phi)*10\ \Omega$ $r6=600\ \Omega$ $r7=(\phi-330)*10\ \Omega$ $r8=(360-\phi)*10\ \Omega$ Kirchhoff's laws are used to obtain the voltage profile shown in FIG. 23*a* in the range $300° \leqq \phi \leqq 330°$.

If the angle $\phi$ is changed between 330° and 360° as shown in FIG. 15*a*, an equivalent circuit as shown in FIG. 15*b* is obtained. The resistance elements in FIG. 8*b* are calculated as follows:

$r1=600\ \Omega$ $r2=600\ \Omega$ $r3=600\ \Omega$ $r4=600\ \Omega$ $r5=(\phi-330)*10\ \Omega$ $r6=(390-\phi)*10\ \Omega$ $r7=(\phi-300)*10\ \Omega$ $r8=(360-\phi)*10\ \Omega$ Kirchhoff's laws are used to obtain the voltage profile shown in FIG. 23*a* in the range $330° \leqq \phi \leqq 360°$.

Over $0° \leqq \phi \leqq 360°$, the curve profile shown in FIG. 23*a* is thus obtained as a whole. For larger angles of rotation than 360°, the angle of rotation can always be considered modulo 360°.

If a voltage of U=+5V is applied to the contact 22.2 (FIG. 4*a*) and the contact 22.5 is connected to ground and the voltage U1 is measured at 22.3, the voltage U2 is measured at 22.4, the voltage U3 is measured at 22.6, and the voltage U4 is measured at 22.1, a curve profile shifted through −60° through at the angle of rotation $\phi$ is obtained which is shown in FIG. 23*b*.

Ascertaining the Angle of Rotation $\phi$ from the Measured Voltages

First of all, a voltage U=5V is applied between the contacts 22.1 and 22.4. It goes without saying that none of the contacts need to be grounded; the voltages described above are then measured for the potential of the contact 22.4. A check is then performed to determine whether the conditions U4=3.33±0.2V and U3=1.66±0.2V are met. If so, the angle of rotation is determined from the voltages U4 and U3, as described further below. If not, the voltage U is applied using the next contacts 22.2 and 22.5 counterclockwise.

FIG. 4*a* shows an advancement angle β which, in respect of the center M, indicates the angle between the contact 22.1 and the contact at which the voltage U is applied. If the conditions U4=3.33±0.2V- and U3=1.66±0.2V are satisfied when the voltage U drops across the contacts 22.1 and 22.4, β=0°. If the conditions are satisfied when the voltage U drops across 22.2 and 22.5, β=60°, and so on.

The contacts which are used to apply the voltage U are thus advanced by one respective segment (β=60°) until the conditions U4=3.33±0.2V and U3=1.66±0.2V are satisfied.

The angle of rotation ϕ can be calculated as follows from the measured voltages.

If $U1>\frac{1}{2}U=2.5V$, then: $\phi=(\beta+(900-2.5*U1)/5) \bmod 360$,

If $U1\leqq\frac{1}{2}U=2.5V$, then: $\phi=(\beta+(900-2.5*U2)/5) \bmod 360$

In this case, mod 360 denotes the modular function for which (a+z 360°) mod 360=a for all a between 0° and 360° and all integers z.

Calculation of the Measured Voltages on the Basis of the Angle of Rotation for the Third Embodiment For the embodiment shown in FIG. 17*a*, a method according to the invention is performed by virtue of a current I being sent by the first and the second current-flow contact 46 and 48. To this end, either a voltage U or a current I is applied.

For the following calculations, an angle of spread a between the three arms 40, 42, 44 of α=120° is assumed. For the resistance per unit length, a value of 10Ω per degree for the segment 12.2 and 100Ω per degree for the segment 12.1 is assumed.

When the first current-flow contact 46 of the first arm 40 and the measurement contact 50 of the arm 44 (FIG. 17*a*) are used to apply a voltage U=5V between the contact points $P_1$(+5V) and $P_3$(ground) and the angle ϕ is changed between 0° and 600, an equivalent circuit as shown in FIG. 17*b* is obtained. The resistance elements ri in FIG. 17*b* are calculated as follows:

$r1$=no influence $r2$=1200 Ω

$r3=(60-\phi)*10$ Ω

$r4=(60+\phi)*100$ Ω

$r5$=no influence

If, as FIG. 18*a* shows, the angle ϕ is changed between 60° and 120°, an equivalent circuit as shown in FIG. 18*b* is obtained. The resistance elements in FIG. 18*b* are calculated as follows:

$r1$=no influence $r2=(180-\phi)*10$ Ω

$r3=(\phi-60)*100$ Ω

$r4$=1200

$r5$=no influence

Figure 19A:
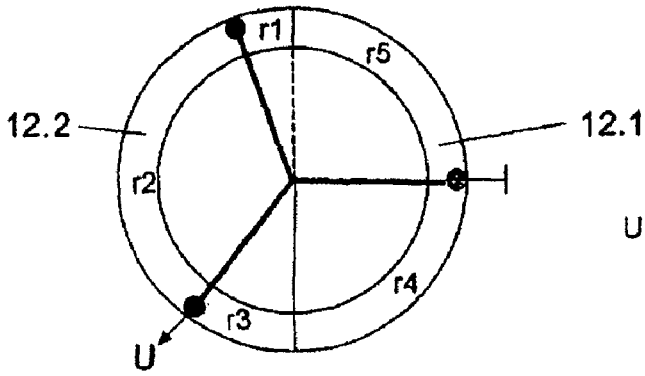
Figure 19B:
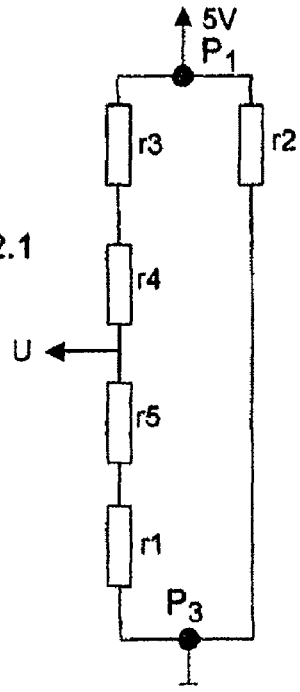

If, as FIG. 19*a* shows, the angle ϕ is changed between 120° and 180°, an equivalent circuit as shown in FIG. 19*b* is obtained. The resistance elements in FIG. 19*b* are calculated as follows:

$r1=(\phi-120)*10$ Ω

$r2$=no influence $r3=(180-\Omega)*10$ Ω

$r4=(\phi-60)*100$ Ω

$r5=(240-\phi)*100$

Figure 20A:
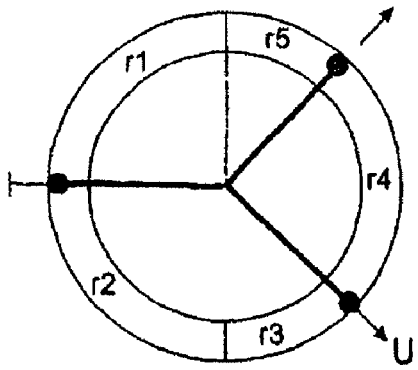
Figure 20B:
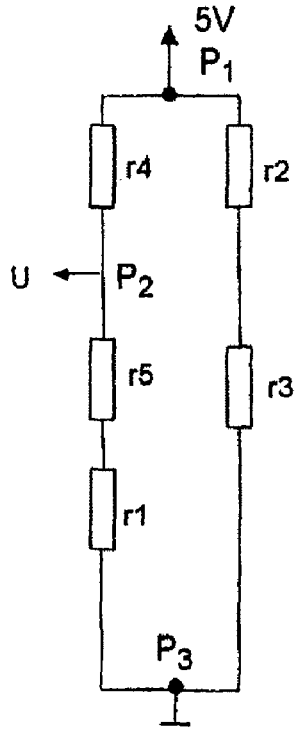

If, as FIG. 20*a* shows, the angle ϕ is changed between 180° and 240°, an equivalent circuit as shown in FIG. 20*b* is obtained. The resistance elements in FIG. 20*b* are calculated as follows:

$r1=(\phi-120)*10$ Ω

$r2$=no influence $r3$=no influence $r4$=12 000 Ω

$r5=(240-\phi)*100$ Ω

Figure 21A:
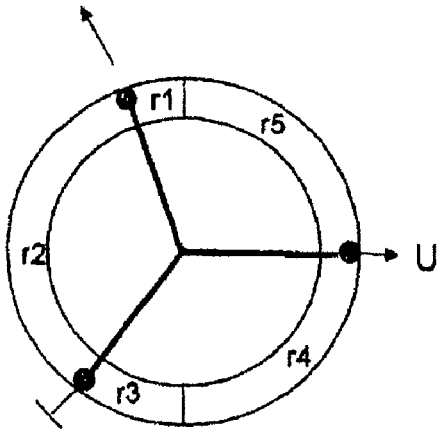
Figure 21B:
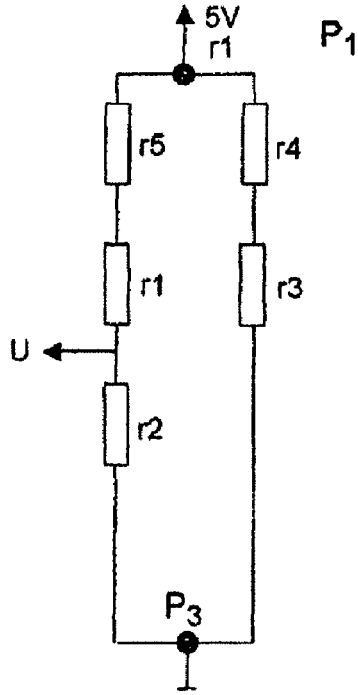

If, as FIG. 21*a* shows, the angle ϕ is changed between 240° and 300°, an equivalent circuit as shown in FIG. 21*b* is obtained. The resistance elements in FIG. 21*b* are calculated as follows:

$r1=(\phi-240)*10$ Ω

$r2$=1200

$r3$=no influence $r4$=no influence $r5=(360-\phi)*100$ Ω

Figure 22A:
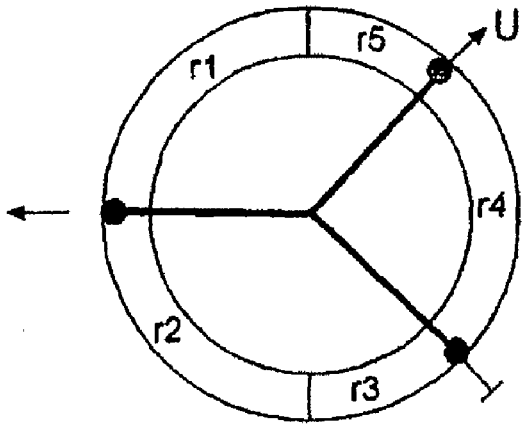
Figure 22B:
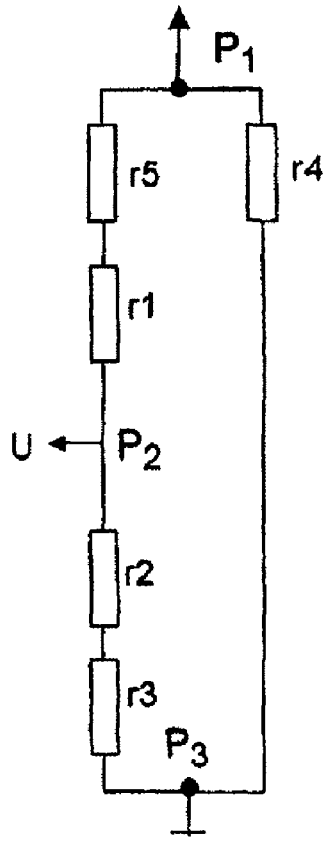

If, as FIG. 22*a* shows, the angle ϕ is changed between 300° and 360°, an equivalent circuit as shown in FIG. 22*b* is obtained. The resistance elements in FIG. 22*b* are calculated as follows:

$r1=(\phi-240)*10$ Ω

$r2=(420-\phi)*10$ Ω

$r3$=no influence $r4$=no influence $r5=(360-\phi)*100$

For a voltage U=5V, the above part-calculations result in the curve profile shown in FIG. 24 for a voltage $U_{meas}$, which is applied between the contact point $P_2$ and the contact point $P_3$, over the angle of rotation ϕ.

If a voltage U is applied between the connections $P_2$(+5v) and $P_1$(ground) and the voltage $U_{meas,2}$ is measured at $P_3$, the result is a curve profile shifted through the advancement angle β=−120°.

If a voltage is applied between the connections $P_3$(+5V) and $P_2$(ground) and the voltage $U_{meas,3}$ is measured at $P_1$, the result is a curve profile shifted through the advancement angle β=+120°.

For measuring the angle, a voltage U is first of all applied between the contact points $P_1$ and $P_3$, subsequently between the contact points $P_2$ and $P_3$ and then between $P_3$ and $P_1$. The voltages $U_{meas}$, $U_{meas,2}$ and $U_{meas,3}$ described above are respectively measured. Each combination of these three voltages corresponds to precisely one angle of rotation .phi., which is interpolated from a table which is stored in a digital memory of an electrical evaluation circuit in the form of a microprocessor.

A prosthesis according to the invention comprises two elements which can be swiveled through a swivel angle relative to one another. If the prosthesis is a knee prosthesis, for example, the two limbs are the thigh (shank) and the lower leg. The two limbs of the prosthesis are connected to one another such that swiveling the two limbs relative to one another in a unique manner prompts rotation of the connecting apparatus relative to the segments.

In other words, swiveling the two limbs relative to one another results in a movement of the connecting apparatus of the potentiometer relative to the segments, and conversely a rotary movement of the connecting apparatus of the potentiometer relative to the segments of the potentiometer can be effected only if the two limbs are moved relative to one another.

The potentiometer can then be used, as described above, to determine the angle at which the lower leg is oriented relative to the thigh, for example. If the prosthesis according to the invention is a forearm prosthesis, for example, the two limbs are the upper arm (stub) and the forearm. If the prosthesis is a finger prosthesis, a corresponding situation applies.

It is particularly beneficial if the segments and the flexible conductor are surrounded in a liquid-tight manner by a flexible jacket. In this case, the prosthesis can be immersed in water without fear of a short. It is possible for the potentiometer to comprise an electrical controller which is set up to ascertain the rotary position of the potentiometer. The electrical controller is then preferably likewise surrounded by the jacket. It is possible for the controller to be designed to send the rotary position to outside the jacket in encoded form wirelessly or by wire.

LIST OF REFERENCE SYMBOLS

10 Potentiometer
12.1, 12.2, 12.3, 12.4, 12.5, 12.6 Segment
14 Contact side
16 Edge
18 First section
20 Second section
22 Electrical contact
24 Current source
26 Support
28 Inner spacing ring
30 Outer spacing ring
32 Pressure membrane
34 Flexible conductor
36 Coupling device
38 Connecting apparatus
40 First arm
42 Second arm
44 Third arm
46 First current-flow contact
48 Second current-flow contact
50 Measurement contact
I Current
$K_{outside}$ Outer circular-ring radius
$K_{inside}$ Inner circular-ring radius
M Center
$\phi$ Angle of rotation
$\alpha$ Angle of spread
$\beta$ Advancement angle
$P_1$, $P_2$, $P_3$ Point
r Resistance
U voltage

The invention claimed is:

1. A potentiometer, having (a) a first electrically conductive segment which has a first contact side which is delimited by a first circumferential edge;

(b) at least one second electrically conductive segment which has a second contact side which is delimited by a second circumferential edge;

(c) wherein said first contact side and said at least one second contact side are situated in a common plane;

(d) wherein said first and said at least second electrically conductive segments form a closed arrangement in which each segment has exactly one neighboring segment to each side and wherein an electrical contact is arranged between two neighboring segments;

(e) a connecting apparatus rotatable about an angle of rotation and electrically connecting a first contact point on said first contact side or on said at least one second contact side to at least one second contact on said first contact side or on said at least one second contact on said first contact side or on said at least one second contact side;

(f) an electric energy source that is connected to at least two electrical contacts so that an electric current flows through all segments; and (g) a voltage ascertainment apparatus that is connected to at least two of said electrical contacts to measure at least one voltage which depends on said angle of rotation so that said angle of rotation is derivable from said measured voltages.

2. The potentiometer as claimed in claim 1, characterized in that the segments are circular ring segments.

3. The potentiometer as claimed in claim 1, characterized in that the segments are respectively of the same magnitude.

4. The potentiometer as claimed in claim 1, characterized in that the connecting apparatus connects precisely two contact points.

5. The potentiometer as claimed in claim 2, characterized in that the connecting apparatus is rotatably mounted at a center of rotation and the center of rotation coincides with a circular ring center.

6. A potentiometer for use in a prosthesis, said potentiometer comprising:

(a) a first electrically conductive segment which has a first contact side which is delimited by a first circumferential edge;

(b) at least one second electrically conductive segment which has a second contact side which is delimited by a second circumferential edge;

(c) wherein said first contact side and said at least one second contact side are even and are situated in a common plane;

(d) wherein said first and said at least one second electrically conductive segments form a closed arrangement in which each segment has exactly one neighboring segment to each side and wherein an electrical contact is arranged between two neighboring segments;

(e) a connecting apparatus rotatable about an angle of rotation and electrically connecting a first contact point on said first contact side or on said at least one second contact side to at least one second contact on said first contact side or on said at least one second contact on said first contact side or on said at least one second contact side;

(f) wherein swiveling of said prosthesis results in a movement of said connecting apparatus relative to said first and said at least one second electrically conductive segments;

(g) an electric energy source that is connected to at least two electrical contacts so that an electric current flows through said first and said at least second electrically conductive segments;

(h) a voltage ascertainment apparatus that is connected to at least two of said electrical contacts to measure at least one voltage which depends on said angle of rotation so that said angle of rotation is derivable from said measured voltages, thereby measuring a swiveling action of said prosthesis.

7. The potentiometer as claimed in claim 1, characterized in that the connecting apparatus comprises a closed, flexible conductor which is arranged with respect to the electrically conductive segments such that it can be brought into electrical contact with one of the segments by pressure at a contact point.

8. The potentiometer as claimed in claim 7, characterized in that the segments and the flexible conductor are surrounded in a liquid-tight manner by a flexible jacket.

9. The potentiometer as claimed in claim 7, characterized by a coupling device for applying a pressure to the flexible conductor at least two contact points.

10. The potentiometer as claimed in claim 1, wherein the controller is designed to electrically connect two respective contacts to a current source or voltage source and at least one respective, particularly two respective, contacts to the voltage ascertainment apparatus.

11. A method for ascertaining an angular position for a component, having the following steps:

(a) providing a potentiometer having a first electrically conductive segment which has a first contact side which is delimited by a first circumferential edge, at least one second electrically conductive segment, which has a second contact side which is delimited by a second circumferential edge, wherein said first contact side and said at least one second contact side are situated in a common plane, wherein said at least two segments form a closed arrangement in which each segment has exactly one neighboring segment to each side and wherein an electrical contact is arranged between two neighboring segments, a connecting apparatus rotatable about an angle of rotation and electrically connecting a first contact point on said first contact side or on said at least one second contact side to at least one second contact on said first contact side or on said at least one second contact side, an electric energy source that is connected to at least two electrical contacts so that an electric current flows through all segments, and a voltage ascertainment apparatus that is connected to at least two of said electrical contacts to measure at least one voltage which depends on said angle of rotation so that said angle of rotation is derivable from said measured voltages, (b) mechanically connecting the component to a connecting apparatus or the segments of a potentiometer, (c) connecting a current source or a voltage source to the potentiometer, so that an electric current flows through at least one segment, (d) ascertaining at least one first voltage which drops across a portion of the potentiometer on the basis of the current, (e) ascertaining a rotary position for the connecting apparatus based on the said at least one first voltage, and (f) ascertaining an angular position of the component based on the rotary position of the connecting apparatus.

12. The method as claimed in claim 11, in which the current source is connected to the potentiometer such that the current flows through all segments.

13. The method as claimed in claim 11, characterized in that the ascertainment of at least one first voltage comprises the the step of assessing n voltages between n pairs of electrical contacts, wherein $n \geqq 1$, particularly $n>1$, and wherein the n pairs are chosen such that each rotary position of the connecting apparatus corresponds to precisely one combination of the n voltages.

14. The method as claimed in claim 11, characterized in that the voltages are voltages which drop across precisely one segment.

15. The method as claimed in claim 11, characterized in that all voltages are measured using the same voltage ascertainment apparatus.

16. A potentiometer, comprising:

(a) a first electrically conductive segment which has a first contact side which is delimited by a first circumferential edge;

(b) a second electrically conductive segment, which has a second contact side which is delimited by a second circumferential edge;

(c) at least a third electrically conductive segment, which has at least a third contact side which is delimited by at least a third circumferential edge;

(d) wherein said first contact side and said at second contact side and said third contact side are even and are situated in a common plane;

(e) wherein said segments form a closed arrangement in which each segment has exactly one neighboring segment to each side and wherein an electrical contact is arranged between two neighboring segments, (f) a connecting apparatus rotatable about an angle of rotation and electrically connecting a first contact point on said first contact side of said first segment to at least one second contact on said second contact side or on said third contact side;

(g) an electric energy source of that is connected to at least two electrical contacts so that an electric current flows through all segments, (h) a voltage ascertainment apparatus that is connected to at least two of said electrical contacts to measure a voltage which depends on said angle of rotation so that said angle of rotation is derivable from said measured voltages.

17. A potentiometer for use in a prosthesis, the prosthesis having a first limb and a second limb which can be swiveled through a swivel angle relative to one another, the potentiometer comprising:

(a) a first electrically conductive segment which has a first contact side which is delimited by a first circumferential edge;

(b) a second electrically conductive segment which has a second contact side which is delimited by a second circumferential edge;

(c) at least a third electrically conductive segment which has at least a third contact side which is delimited by at least a third circumferential edge;

(d) wherein said first contact side and said at second contact side and said third contact side are even and are situated in a common plane;

(e) wherein said segments form a closed arrangement in which each segment has exactly one neighboring segment to each side and wherein an electrical contact is arranged between two neighboring segments, (f) a connecting apparatus rotatable about an angle of rotation and electrically connecting a first contact point on said first contact side of said first segment to at least one second contact on said second contact side or on said third contact side;

(g) a electric energy source of that is connected to at least two electrical contacts so that an electric current flows through all segments;

(h) a voltage ascertainment apparatus that is connected to at least two of said electrical contacts to measure a voltage, (I) wherein swiveling said to limbs relative to one another results in a movement of said connecting apparatus relative to said segments; and (j) a controller which calculates said swivel angle from said measured voltages.

18. The potentiometer as claimed in claim 5, characterized in that said connecting apparatus is in a form such that said first contact point is arranged so as to be offset from said second contact point by an angle of spread which is of such magnitude that said contact points cannot be situated in one segment.

19. The potentiometer as claimed in claim 6, wherein the prosthesis is an arm prosthesis, a hand prosthesis or a knee prosthesis.

20. The potentiometer as claimed in claim 7, characterized in that the specific electrical resistance in a segment is the same.

21. The potentiometer as claimed in claim 8, characterized in that the specific electrical resistance of two adjacent segments is the same.

* * * * *